US008001656B2

(12) United States Patent
Ramsauer

(10) Patent No.: US 8,001,656 B2
(45) Date of Patent: Aug. 23, 2011

(54) HANDLE FOR MOUNTING IN AN OPENING

(76) Inventor: Dieter Ramsauer, Schwelm (DE)

( * ) Notice: Subject to any disclaimer, the term of this patent is extended or adjusted under 35 U.S.C. 154(b) by 0 days.

(21) Appl. No.: 10/556,837

(22) PCT Filed: Feb. 28, 2005

(86) PCT No.: PCT/EP2005/002085

§ 371 (c)(1),
(2), (4) Date: Nov. 15, 2005

(87) PCT Pub. No.: WO2005/083207

PCT Pub. Date: Sep. 9, 2005

(65) Prior Publication Data

US 2007/0062004 A1 Mar. 22, 2007

(30) Foreign Application Priority Data

Feb. 27, 2004 (DE) ..... 20 2004 003 238 U
Sep. 20, 2004 (DE) ..... 20 2004 014 766 U

(51) Int. Cl.
*A47B 95/02* (2006.01)

(52) U.S. Cl. ..... 16/416; 16/406; 16/412; 16/413; 16/422

(58) Field of Classification Search ..... 16/406, 16/412, 413, 419, 420, 430, 444, 446, 70, 16/292, 110.1; 24/289, 292, 458; 294/158; 312/319.1; 411/508, 913
See application file for complete search history.

(56) References Cited

U.S. PATENT DOCUMENTS 927,240 A * 7/1909 Hoffman ..... 292/78
1,304,700 A * 5/1919 Otte ..... 16/412
1,538,320 A * 5/1925 Gullong ..... 40/663
1,671,328 A * 5/1928 Joseph et al. ..... 292/162
2,033,806 A * 3/1936 Baker et al. ..... 292/33
2,142,953 A * 1/1939 Raymond ..... 16/444
2,469,893 A * 5/1949 Rockwell ..... 292/76
2,494,159 A * 1/1950 Bernstein ..... 220/759
2,616,122 A * 11/1952 Curtiss, Jr. ..... 16/412
2,793,386 A * 5/1957 Muhlhauser ..... 16/416
2,821,425 A * 1/1958 Vogt ..... 292/336.3
3,126,728 A * 3/1964 Nehls ..... 70/169
3,312,138 A * 4/1967 Cumming ..... 411/21
3,426,385 A * 2/1969 Gutshall ..... 16/412
3,583,736 A * 6/1971 Willimzik ..... 292/16
3,669,481 A * 6/1972 Bergmann ..... 292/49
3,775,808 A * 12/1973 Little ..... 16/412
3,921,334 A * 11/1975 Black, Sr. ..... 49/56

(Continued)

*Primary Examiner* — Victor Baston
*Assistant Examiner* — Roberta S Delisle
(74) *Attorney, Agent, or Firm* — Frommer Lawrence & Haug LLP

(57) ABSTRACT

A handle has at least one holding plate which can be mounted in an opening in a thin wall such as a sheet-metal cabinet door, a head part, such as a flange or olive-shaped handle, which overlaps the rim of the opening of the thin wall on its (outer) side, and a body part which proceeds from the head part and can be pushed through the opening in the thin wall, and a holding part which is carried by the body part, supported on the other (rear) side of the thin wall, and is separate from the body part, wherein the holding part is formed by holding elements which project in a flexible manner from the body part in the direction of its outer surface and whose free end has an inclined surface for supporting the body part on the rim or edge of the opening without play.

25 Claims, 23 Drawing Sheets

U.S. PATENT DOCUMENTS 5,134,754 A * 8/1992 Vickers ..... 16/416
5,355,554 A * 10/1994 Magoon ..... 16/412
5,632,061 A * 5/1997 Smith et al. ..... 16/444
5,991,976 A * 11/1999 Adams et al. ..... 16/444
6,009,932 A * 1/2000 Smith ..... 160/371
6,048,125 A * 4/2000 Droche et al. ..... 403/12
6,106,055 A * 8/2000 Fischer ..... 296/214
6,401,302 B1 * 6/2002 Josserand et al. ..... 16/444
6,415,478 B1 * 7/2002 Watanabe et al. ..... 16/444
7,146,831 B2 * 12/2006 Antonucci et al. ..... 70/208
2002/0059698 A1 * 5/2002 Josserand et al. ..... 16/444
2005/0144993 A1 * 7/2005 Antonucci et al. ..... 70/208

* cited by examiner

HANDLE FOR MOUNTING IN AN OPENING

CROSS-REFERENCE TO RELATED APPLICATIONS

This application claims priority of International Application No. PCT/EP2005/002085, filed Feb. 28, 2005 and German Application No. 20 2004 003 238.4, filed Feb. 27, 2004 and German Application No. 20 2004 014 766.1, filed Sep. 20, 2004, the complete disclosures of which are hereby incorporated by reference.

BACKGROUND OF THE INVENTION

The invention is directed to a handle which has at least one holding plate which can be mounted in an opening in a thin wall such as a sheet-metal cabinet door, a head part, such as a flange or olive-shaped handle, which overlaps the rim of the opening of the thin wall on its (outer) side, and a body part which proceeds from the head part and can be pushed through the opening in the thin wall, and a holding part which is carried by the body part, supported on the other (rear) side of the thin wall, and is separate from the body part.

DESCRIPTION OF THE RELATED ART

A handle of the type mentioned above is already known from a brochure entitled "Handbook 2000" by Southco. In the prior art, the holding part comprises a screw that is screwed into corresponding threaded bore holes of the body part from the rear and secures this body part in the opening of a sheet-metal switch cabinet. This type of mounting has the disadvantage that it is not immune to vibrations. Further, mounting is complicated; in particular, parts can be lost. Blind mounting is also impossible because the back side must be accessible.

OBJECT OF THE INVENTION

It is the primary object of the invention to improve the known arrangement, particularly with respect to achieving immunity to vibrations and simplifying mounting. Loose parts such as screws should be avoided when possible because they can fall into the device and cause malfunctions or even outages.

When used in the furniture industry, loss of thickness due to shrinkage of wood can be compensated automatically so that the handles remain securely anchored.

SUMMARY OF THE INVENTION

The object is met according to the invention in that the holding part is formed by holding elements which project in a flexible manner from the body part in the direction of its outer surface and whose free end has an inclined surface for supporting the body part on the rim or edge of the opening in the thin wall without play.

A majority of the tasks set by the invention are already fulfilled by means of this step. In particular, fastening is vibration-proof, mounting is greatly simplified and, on the other hand, very thin sheet metal can also be securely held. Different thicknesses of sheet metal are held without play when they do not exceed determined ranges. Loose parts are usually not required. Very thin sheet metal can be strengthened by additional sheet metal parts. Further, sheet metal parts serving as panels can be fastened with the handle simultaneously.

FURTHER RELATED ART

A clip-like fastening of the kind mentioned above for the handle in the form shown herein was not previously known, nor are its advantages. A clip fastening for quick mounting of a lock housing is known with reference to U.S. Pat. No. 5,435,159, wherein a lock housing of this kind is arranged, for example, in a round opening in a thin wall. The housing which is intended for a sash lock comprises a head part, namely, a flange, which must be arranged on an outer side of the thin wall and which overlaps the outer rim of the opening. A body part which projects through the opening in the mounted position proceeds from this head part and flexible tongue elements project from the body part in the direction of its outer surface which has an inclined surface at the free end for supporting the body part without play on the frame of the opening of the other, inner side of the thin wall. In this case, the disadvantage is that the holding force of the holding elements or tongue elements that are integral with the body part is dependent upon their spring tension which depends upon the plastic material that is used and therefore the magnitude of the holding force cannot be made as large as desired. However, very large forces must often be absorbed when using the handle, so that this type of clip fastening cannot readily be transferred to a handle part.

EP 0258491 discloses a construction similar to that known from U.S. Pat. No. 5,435,159 with which a lock cylinder can be fastened in thin-walled doors, drawers or the like by means of a plastic housing which receives the lock cylinder and forms the holding tongues. Common variations of the structural component parts to be locked can be adapted to in a desired manner by means of inclined surfaces at the ends of the tongues. It is also stated in column 9 of the reference that the springing tongues can no longer deflect inward after the lock cylinder is mounted in the housing. This prior art has the disadvantage that a very particular design, namely, a round housing with a lock cylinder inserted therein, must be provided to make it possible to lock the tongues in this way after mounting. In this case also, it does not seem obvious to transfer this tongue fastening to a handle.

FURTHER ASPECTS OF THE INVENTION

In the handle according to the invention, in which the body part and the holding part are two separate parts and are not injection molded in one piece from plastic as in the two references cited above, the load capacity is substantially greater because, if required, a less durable plastic material which can easily be injection molded can be combined with a stronger material such as metal so that the desired strength of the handle is achieved by a corresponding choice of material.

According to a further development of the invention, two holding elements which are arranged diametrical to one another are provided and are acted upon by pressure elements such as spring arrangements, particularly a coil spring common to the two holding elements or two coil springs or wedge arrangements such as conical screws. Since the spring arrangements can be provided with spring force that can be freely selected, per se, the locking force can be adapted to the respective task and does not depend upon the plastic material.

In the prior art, the locking force is highly dependent upon the material characteristics of the plastic that is used unless a pin is used; but this in turn complicates mounting in an undesirable manner because blind mounting in particular is impossible. However, this can be provided according to the invention.

According to a further development of the handle, the holding elements are levers which are arranged at a distance from the rear surface of the thin wall so as to be rotatable in a defined manner around an axis parallel to the plane of the thin wall. This embodiment form increases the holding force while retaining the same spring strength.

Alternatively, the holding elements are levers which are arranged at a distance from the rear surface of the thin wall so as to be rotatable in a defined manner around an axis perpendicular to this surface. Accordingly, four holding points can be achieved simultaneously with two levers so as to increase the holding force while the spring tension remains unchanged.

According to a further development of the invention, the holding elements are slides which are arranged so as to be displaceable in a cylinder that lies parallel to the plane of the thin wall and is rectangular in cross section and are held against the force of a pressure spring by a hook arrangement that locks between the slides themselves or in the cylinder. The advantage of this construction consists in the relatively small structural height on the rear side of the door leaf. A similar construction results when the holding elements are slides of rigid material such as metal which are arranged so as to be displaceable in a cylinder that is parallel to the plane of the thin wall and rectangular in cross section and are held against the force of a pressure spring by a pin arrangement that is arranged between them. This is a particularly durable handle arrangement.

The cylinder can have a partial dividing wall or undercut or opening edge at which the slide can be supported axially by a shoulder or hook. This shows the variability of the design according to the invention, which is an advantage.

It is possible to reduce the size of the construction according to a further development of the invention when the holding element has an opening which receives a spiral pressure spring by at least a portion of its diameter.

Projections can project into the opening in order to hold the spring element radially.

In particular, the holding elements can be formed by two flat metal pieces lying next to one another, each of which has an opening, these two openings together forming a space which receives a spiral pressure spring by at least a portion of its diameter. The design advantageously enables pre-mounting in which these three parts are held together by the spring in such a way that they can be manipulated separately from the rest of the handle. This also applies when the holding elements are formed by two metal pieces which lie next to one another and which form projections and recesses which are directed toward one another and which limit the axial sliding movement relative to one another. This has the additional advantage that the movement path is limited without taking further steps with respect to the cylinder.

According to a further development of this design, the holding elements are formed by two plastic pieces or metal pieces which lie next to one another and which form projections and recesses which are directed toward one another and which can be engaged by a rotatable tool or key in such a way that the plastic pieces or metal pieces are displaced relative to one another against the spring force when the tool or key is turned. This makes it possible to draw back the two holding elements that are operative in this case without expending a large amount of finger force and therefore makes it possible to disengage the holding plate from the opening of the thin wall when required. Since this is possible only with a particular tool that is not available to anyone, this is also a favorable aspect with respect to security. As was already mentioned, another advantage can be achieved in that the holding elements are formed by a metal piece or by two metal pieces lying next to one another which is/are held jointly by a spring in such a way that these two or three parts form a manageable unit that is stable in itself.

Instead of a pin arrangement or, in a further development of the pin arrangement, a fixing pin or fixing plug or fixing screw can also be provided for fixing the holding elements after the holding plate is mounted in the opening. The screw must be tightened by hand, if necessary, in order to achieve immunity to vibration.

A design in which the head part has a recess in the area of the holding elements proves advantageous insofar as bulging of the rims of the opening is also innocuous if not too large. When the rims bulge only slightly, the contact surface is increased so that even larger forces can be absorbed.

The holding element can also be formed by a leaf spring that is bent in a suitable manner. According to a further development, the leaf spring can be inserted into a radially extending cavity formed by the body part. The cavity can form a slot or recess in which a projection and recess of the spring lock the latter in a working position in a fixed manner. On the other hand, the leaf spring can be held by a head screw that is screwed into a threaded bore hole formed by the body part. Alternatively, the leaf spring can also be spot-welded or glued to a surface formed by the body part.

Alternatively, the holding plate has an opening like the thin wall and the holding part and the body part have their own head part. The head part and body part can also be two parts that are screwed together or can also be parts that are glued together or parts that are permanently or detachably connected in some other way.

It can be advantageous to arrange a plurality of holding elements next to one another in axial direction of the handle. On the other hand, it is also possible for a second holding plate, which is connected to the first holding plate by means of a retaining brace, to have a construction analogous to that of the first holding plate.

In a particular construction, the handle can penetrate into or be swiveled into or rotated into a housing carrying the holding elements. When the handle has an elongated shape, it is advantageous when it forms a holding plate at both ends and holding elements proceed from this holding plate. The holding elements can be pretensioned in a flexible manner in direction of the handle axis or, alternatively, perpendicular to the direction of the handle axis.

BRIEF DESCRIPTION OF THE DRAWINGS

The invention will be explained more fully in the following with reference to embodiment examples shown in the drawings.

FIGS. 12M, 12N, 120, 12P show details of another embodiment form of the holding element;

FIGS. 17A, 17B and 17C show an embodiment form in which the body part is screwed on;

DESCRIPTION OF THE PREFERRED EMBODIMENT

Figure 1A:
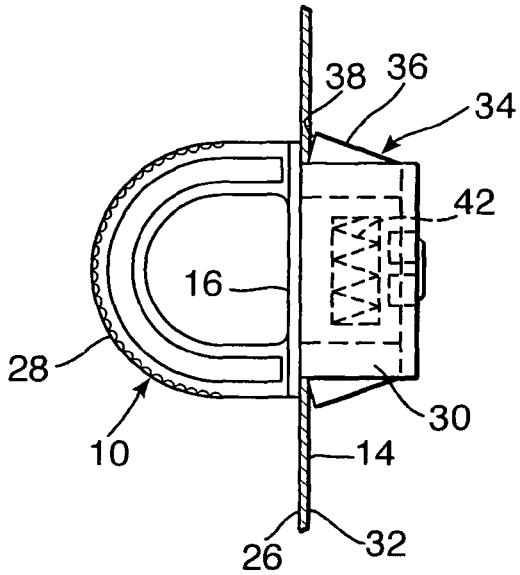
FIG. 1A shows a cross section through a thin wall with an opening in which a handle according to the invention is mounted.
Figure 1B:
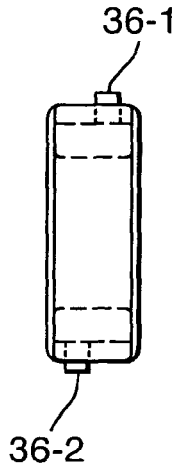
FIG. 1B shows a rear view of the handle shown in FIG. 1A.
Figure 1C:
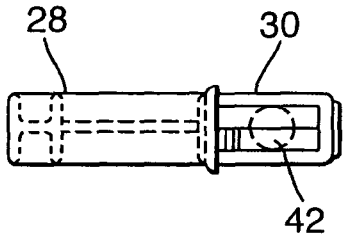
FIG. 1C is a side view of the handle shown in FIG. 1A.
Figure 1D:
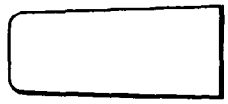
FIG. 1D shows a modified form.

FIGS. 1A, 1B, 1C and (in a somewhat modified form) FIG. 1D show different views of a handle 10 constructed according to the invention with at least one holding plate 16 which can be mounted in an opening 12, which is rectangular in the present case (see, e.g., FIG. 2), in a thin wall 14 such as a sheet-metal cabinet door 14. The holding plate 16 which can be mounted at the thin wall, such as a sheet-metal cabinet door 14, comprises a head part 28, such as a flange or, in this case, an eyelet of a handle, which overlaps the rim 24 of the opening 12 in the thin wall 14 on one (outer) side 26 thereof, and a body part 30 proceeding from the head part 28 which can be slid through the opening 12 in the thin wall 14, and a holding part 34 which is carried by the body part and supported on the other (rear) side 32 of the thin wall 14 and separated from the body part 30. The holding part 34 is formed by holding elements 36 which project flexibly from the body part 30 in direction of its outer surface and whose free end has an inclined surface 38 for supporting the body part 30 without play on the rim or edge 40 of the opening 12 in the thin wall 14. Because of the symmetry of forces, it is advantageous, e.g., according to FIGS. 1A, 1B, to provide two holding elements 36-1 and 36-2 which are arranged diametrically relative to one another and which are acted upon by spring arrangements 42, for example, a coil spring 42 common to the two holding elements 36-1 and 36-2 or a coil spring 42-1, 42-2 (FIG. 27A) in such a way that the holding elements 36 are forced in the direction of the rim 40 of the through-opening 12.

Figure 4A:
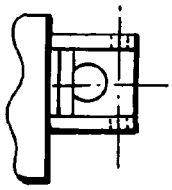
FIG. 4A is a top view.
Figure 4B:
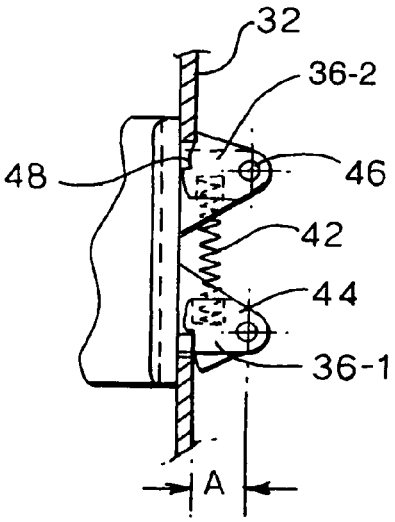
FIG. 4B is a side view of another embodiment form of the invention.

As is shown in FIG. 4B, the holding elements 36-1, 36-2 can be levers 44 which are arranged at a distance A from the (rear) surface 32 of the thin wall 14 around an axis 46 parallel to the plane of the thin wall 14. The angle of rotation of the lever 44 is limited by stop arrangements 48.

Figure 3A:
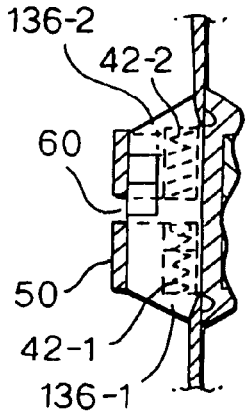
FIG. 3A shows an embodiment form of an associated holding part.
Figure 3B:
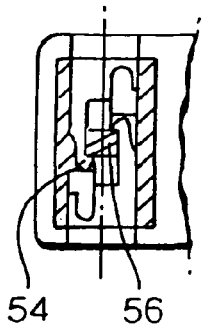
FIGS. 3B and 3C show two axial sectional views through the holding part according to FIG. 3A.
Figure 3C:
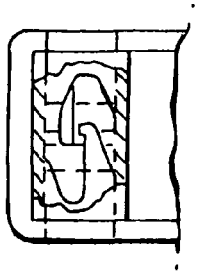
Figure 6A:
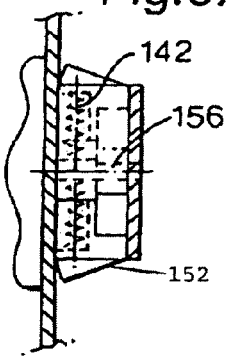
FIG. 6A is a side view of an embodiment of the handle that uses a pin 156 to support the hooks 154 of the slides 152.
Figure 6B:
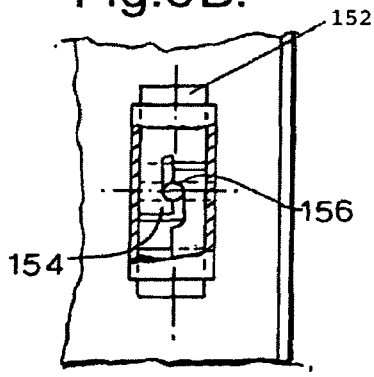
FIG. 6B is a right-hand-side view of the embodiment of FIG. 6A.

According to the view in FIG. 3A, the arrangement of the holding elements 136-1, 136-2 is carried out in such a way that they are arranged as slides 52 which are arranged so as to be axially displaceable in a cylinder 50 that is rectangular in cross section and parallel to the plane of the thin wall 14 or 22, which slides 52 are held against the pressure spring force of the spring 42 by a hook arrangement 54 which locks between the slides 52 themselves or in the cylinder 50, see, e.g., FIG. 3B, with the hooks 54 or (in FIG. 6B) with the hooks 154 which are supported at a wedge 56 or at a pin 156.

Figure 5A:
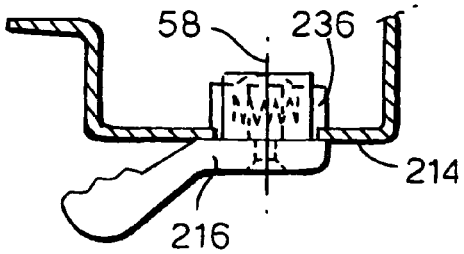
FIG. 5A shows another embodiment form of the invention in section.
Figure 5B:
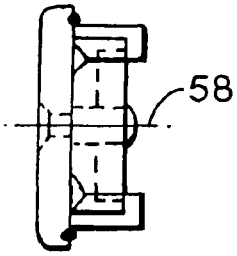
FIG. 5B shows the same embodiment form of the invention from the side.
Figure 5C:
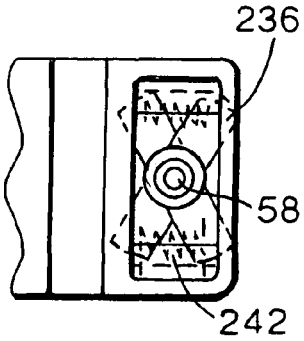
FIG. 5C is a bottom view of the same embodiment form of the invention.

According to FIG. 5A, 5B and 5C, the holding elements 236 shown in the figures are levers 236 which are arranged so as to be rotatable in a defined manner around an axis 58 lying perpendicular to the thin wall 214.

Figure 8B:
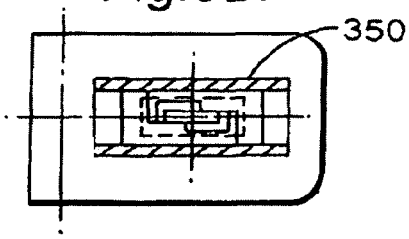
FIGS. 8B, 8C and 8D shows different positions and views of the handle according to FIG. 8A during the fastening process.
Figure 8A:
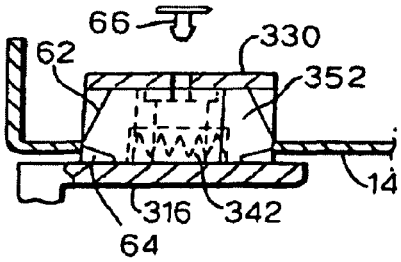
FIG. 8A is a side view of a handle that is constructed differently.
Figure 8C:
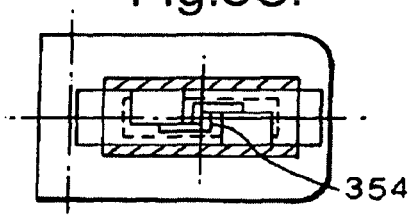
Figure 8D:
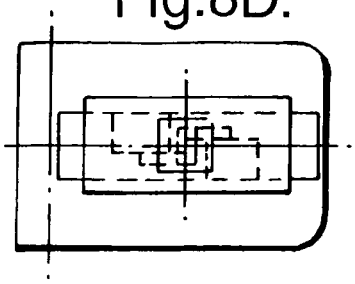
Figure 8E:
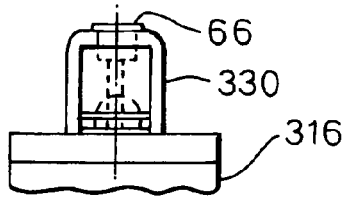
FIG. 8E is a partial side view from the left-hand side of the arrangement shown in FIG. 8A.
Figure 8F:
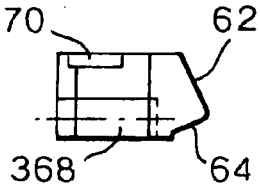
FIGS. 8F, 8G and 8H are three views of the associated holding element.
Figure 8G:
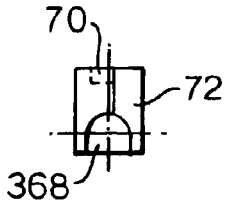
Figure 8H:
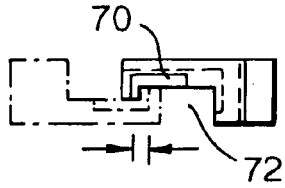

The cylinder 50 can also have a partial dividing wall or undercut or an opening edge 60 at which the slide can be supported axially by a shoulder or a hook. For example, FIG. 8A shows a holding plate 316 with a body part 330 in which slides 352 can move back against the force of a spring 342 through the edges of the opening when pushed in as a result of the bevel 62 (see FIG. 8A) until the edge has reached the clamping surface 64, in which position the spring 342 presses the two fastening elements 352 against the edges of the opening and securely connects the holding plate 316 to the thin wall 14. In order to prevent the loss of the holding elements 352 before being mounted in an opening, they are hooked to one another mutually by means of hooks 354 (see FIG. 8C). Nevertheless, it is possible for them to deflect with respect to one another when pushed in and to reach the position according to FIG. 8B. FIG. 8D shows that the middle position is secured by a fixing plug in the moved out state. Further, the fixing plug 66 prevents the removal of the handle in that the holding elements 352 cannot be pushed back again into the cylindrical housing (see FIG. 8D). The holding element shown in FIGS. 8F, 8G and 8H as an individual part also shows the space 368 for the pressure spring 342. An offset path 70 receives the tip of the fixing plug 66 and makes it possible for the holding elements to carry out only a limited lifting movement. Another offset 72 makes it possible for the two holding elements which are movable relative to one another to slide next to one another.

Figure 7A:
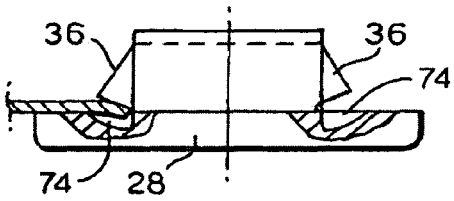
FIG. 7A is a side view of a handle arrangement suitable for bulging sheet metal.
Figure 7B:
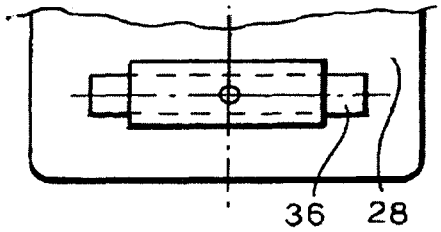
FIG. 7B is a rear view.
Figure 7C:
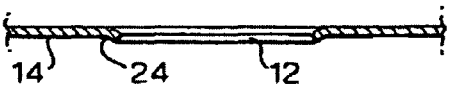
FIG. 7C is a sectional view of the associated sheet metal.

FIG. 7C is a sectional view showing a thin wall 14 of sheet metal in which areas of the opening rims bulge due to high loading. In this case, it is advantageous when the head part has a recess 74 in the area of the holding elements in which the bulging rim areas 24 can be received. This enables a fastening without play by means of pushing the holding element 36 further.

Figure 9A:
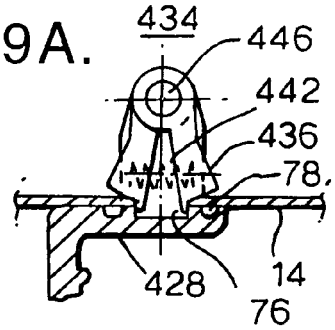
FIG. 9A shows a top view.
Figure 9B:
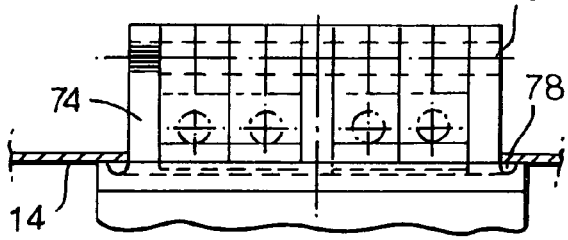
FIG. 9B shows a side view.
Figure 10:
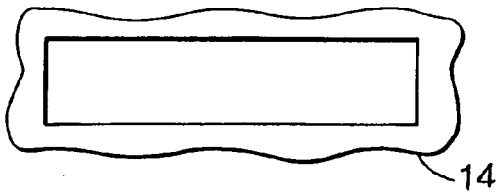
FIG. 10 shows the associated opening of another handle according to the invention.

FIG. 9A is a front view and FIG. 9B is a side view showing a holding plate 434 which is composed of four pairs of holding elements lying next to one another. The construction is similar to that shown in FIGS. 4A, 4B, but a shared pin 446 is provided for holding the holding elements 436 that are located opposite one another. The axial pin 446 is held by means of three supports 74, one support receiving a corrugated surface of the end of the axial pin so as to press upon it.

At their ends, the holding elements 436 have a projection 76 which, in combination with a recess in the head part 428, leads to a limiting of the rotational path due to the spring force 242. The particular advantage in this respect is also that the head part 428 and the body part formed by the supports 74 can also be injection molded in a simple manner, although a groove 78 is provided in this case for a seal which would normally require injection molding dies with sliding arrangements.

In the embodiment form according to FIGS. 11A, 11B, 11C, 11D, the holding elements 536 are formed by two metal pieces or plastic pieces which lie next to one another. They form projections and recesses that are directed toward one another such that the two holding elements 536-1, 536-2 can be drawn back against the force of the spring 542 by a rotatable tool or key 82 by rotating the tool 82 and the handle can accordingly be removed from the thin wall such as a door leaf 514. The construction is advisably carried out in such a way that the lever 82 stays in the opened position automatically so that when there is a plurality of holding plates or handles they can all be brought into the open position simultaneously and all holding plates or handles can accordingly be removed from the door leaf simultaneously.

Figure 11A:
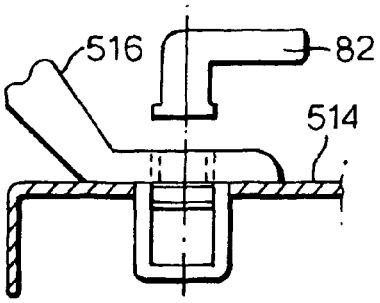
FIGS. 11A, 11B, 11C, 11D show different views of a handle according to the invention that can be unlocked by means of a key.
Figure 11B:
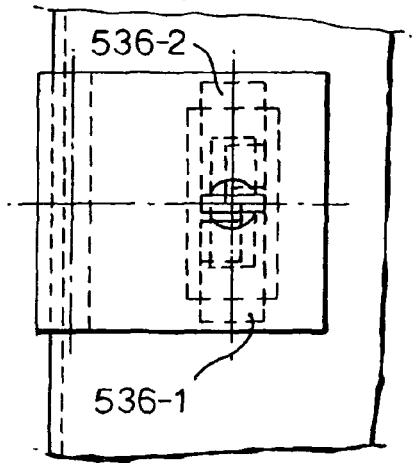
Figure 11C:
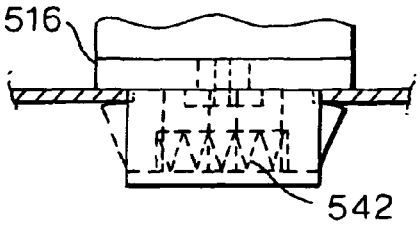
Figure 11D:
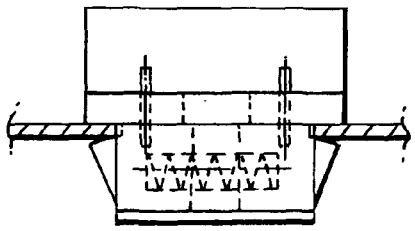
Figure 11E:
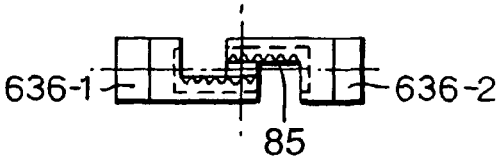
FIGS. 11E and 11F show a modified embodiment form of a handle that can be unlocked by means of a key.
Figure 11F:
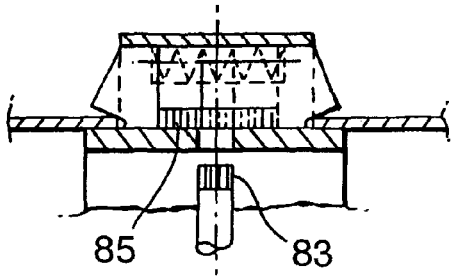

In the embodiment form according to FIGS. 11E and 11F, the tool is provided with a pinion 83 which can engage in corresponding teeth 85 of the two holding elements 636-1, 636-2 and makes it possible for the two holding elements to be drawn back into the housing when the tool and pinion 83 are turned in order to pull the housing out of the opening in the thin wall.

It is possible to pull back the holding elements from both sides of the handle, that is, also from the outer side of the door leaf; accordingly, a blind mounting can also be disassembled again.

Figure 12A:
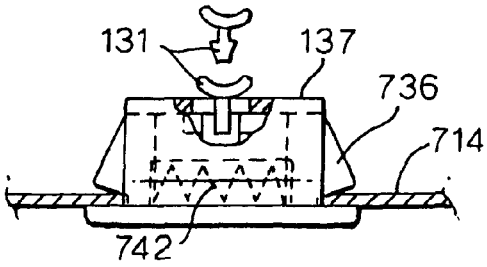
FIGS. 12A, 12B and 12C show different views of another handle that can be unlocked by means of a key.
Figure 12B:
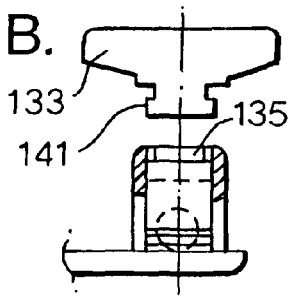
Figure 12C:
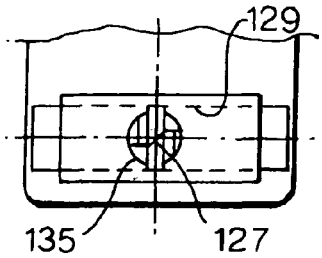

On the other hand, in the embodiment form according to FIG. 12A, 12B, 12C, unlocking by means of a tool is possible only from the inner side.

Figure 12D:
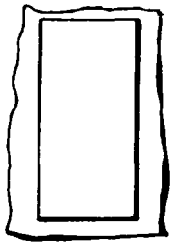
FIG. 12D shows the associated opening in a thin wall.
Figure 12E:
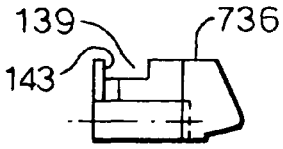
FIGS. 12E and 12F show an associated holding element in two different views.
Figure 12F:
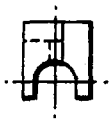
Figure 12G:
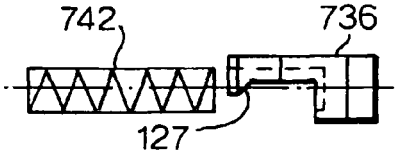
FIGS. 12G, 12H and 12I show additional views of this holding element during operation.
Figure 12H:
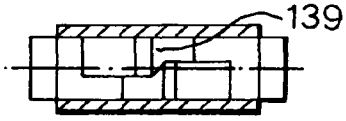
Figure 12I:
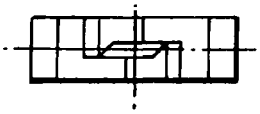
Figure 12J:
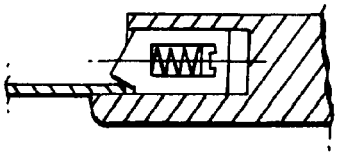
FIGS. 12J, 12K, 12L show another embodiment form of a suitable holding element.

Due to the inclined surface 127 of the holding elements 736 which extends at 45° (see particularly FIG. 12C and FIG. 12G), these holding elements 736 are forced outward in the direction of the channel walls 129 by the spring pressure of the spring 742, so that friction occurs in the channel and the holding elements are possibly already sufficiently fixed by this friction so that the fixing plug 131 shown in FIG. 12A is not needed. When the plug 131 is not required for securing the holding elements 736, the plug 131 also need not be removed when the unlocking key 133 is to be inserted through the opening 135 in the channel cover 137 in the offset area 139 formed by the two holding elements 736. When the key 133 is turned in the counterclockwise direction referring to FIG. 12A, the wings 141 of the key press against the end face 143 of the offset area 139 and move the holding element 736 into the channel until reaching the position shown in FIG. 12I, at which time the key is turned by 90° and holds by itself. The entire unit shown in FIG. 12A can then be pulled out of the opening (shown in FIG. 12D) in the thin wall 714, including additional handle elements which have likewise been brought into the pulled back position with the corresponding key.

In the embodiment form according to FIGS. 12J, 12K, 12L, 12M, 12N, 12O and 12P, the holding element is formed by a flat metal piece having an opening 84 for receiving the spring 42 and two oppositely located projections 86 which receive the spring 842 so as to secure it, so that that a handling unit is formed by the holding element and spring as a unit.

Figure 12K:
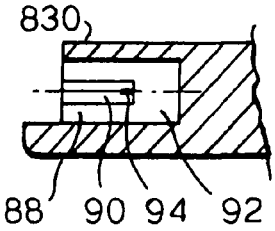
Figure 12L:
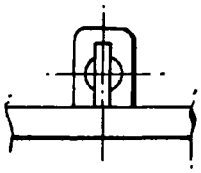
Figure 12M:
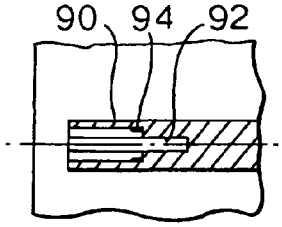
Figure 12N:
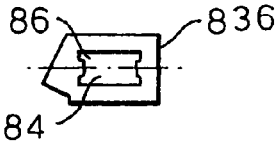
Figure 12O:
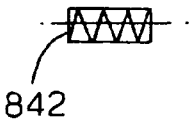
Figure 12P:
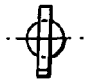

This unit can be received in the correspondingly shaped opening 88 in the body part 830 (see FIGS. 12K and 12M). The cutout 90 provided for the spring is shorter than the corresponding cutout 92 for the holding element 836 so that the spring 842 obtains a contact surface when the holding element 836 is pushed into the position according to FIG. 12J.

Figure 18B:
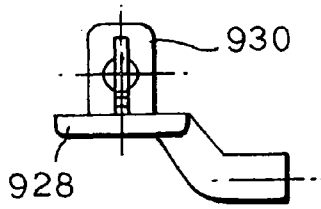
FIGS. 18A, 18B and 18C show different views of an alternative handle with features according to the invention.
Figure 18D:
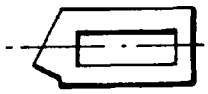
FIGS. 18D, 18E, 18F, 18G show different views of the associated holding element with associated pressure springs.
Figure 18E:
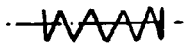
Figure 18A:
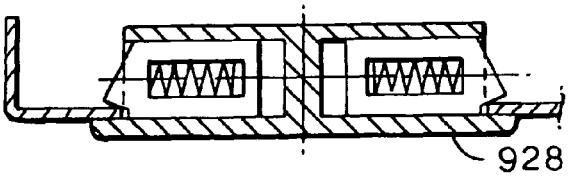
Figure 18F:
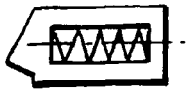
Figure 18G:
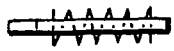
Figure 18C:
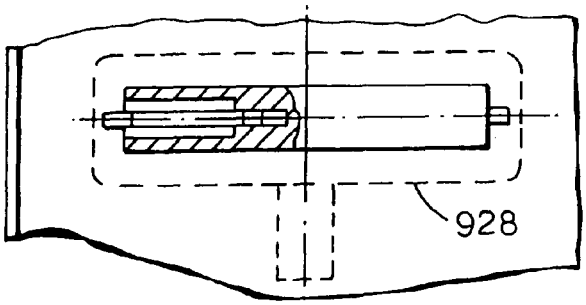
Figure 18H:
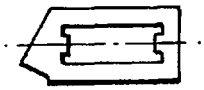
FIGS. 18H, 18I show another embodiment form of the holding element.
Figure 18I:
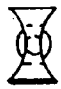

When a knob 94 is arranged at the end of the cutout 90 for the spring, the spring can be secured there and the holding element 836 is prevented from falling out with the spring 842. The embodiment form according to FIGS. 18A, 18B, 18C has a similar construction. The fastening element in FIG. 18D and the spring in FIG. 18E are shown as fixedly assembled parts in FIGS. 18F and 18G. Holding projections are provided in FIG. 18H. In addition, the holding element in this case has a shape that differs from the flat shape for reasons of stability (see FIG. 18I).

Figure 19A:
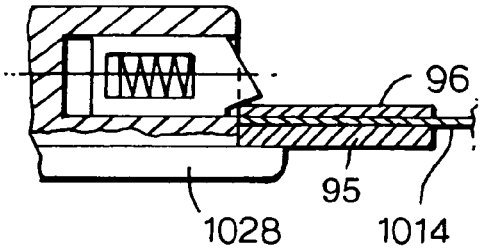
FIGS. 19A, 19B, 19C and 19D show different views of another holding plate with a fastening element with features according to the invention.
Figure 19B:
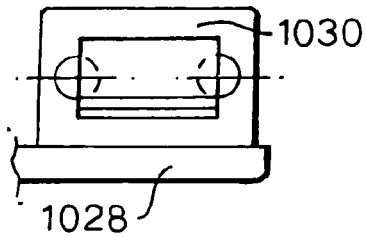
Figure 19C:
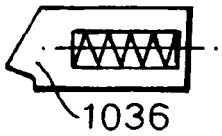
Figure 19D:
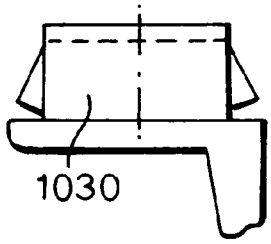

In the embodiment form shown in FIGS. 19A, 9B, 19C, two springs are provided which are inserted laterally into the associated holding element 1036. The other half of the spring element is received by the body part 1030. FIG. 19A shows the characteristic feature that reinforcement plates 95, 96 are provided at both sides in cases where the wall material is very thin and are clamped in by the holding elements so that they also. secure and support the thin door leaf 1014.

Decorative plates or panels can also be fastened in a similar manner.

Figure 19E:
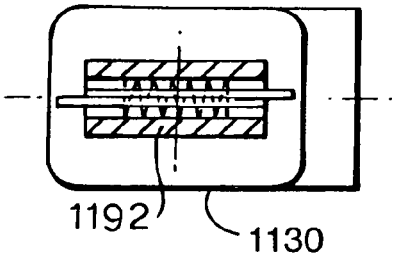
FIGS. 19E, 19F, 19G and 19H show another holding plate and the associated holding elements.
Figure 19F:
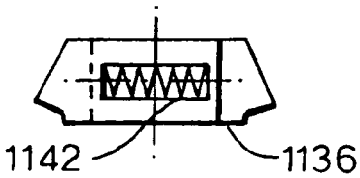
Figure 19G:
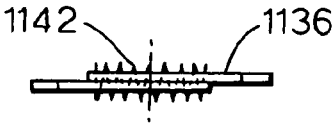

The embodiment form according to FIGS. 19D, 19E, 19F, 19G and 19H show two metal pieces 1136 which are located next to one another and which are held jointly by a spring 1142 in such a way that these three parts form a handling unit which is stable in itself, that is, they can be handled jointly and, if required, can be inserted into a corresponding recess in the body part 1130 as can be seen in FIG. 19E.

By means of a knob 1192 arranged in this area, the construction can also be held in position.

Figure 19H:
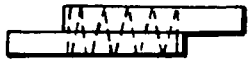
Figure 20A:
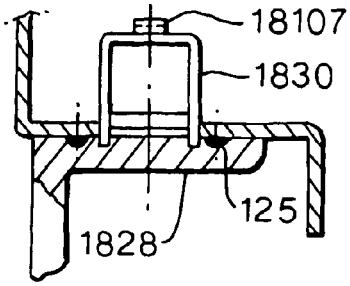
FIGS. 20A, 20B, 20C, 20D, 20E and 20F show different views of another handle with a fastening that is outfitted according to the invention.
Figure 20B:
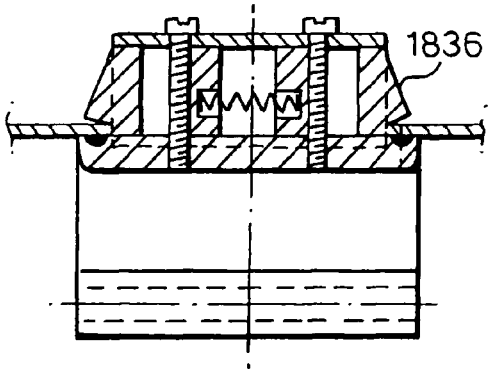
Figure 20C:
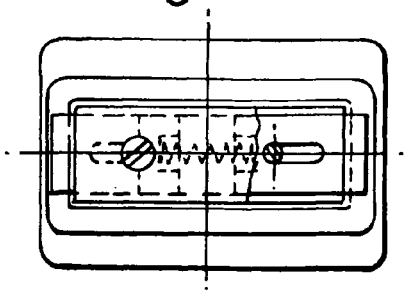
Figure 20D:
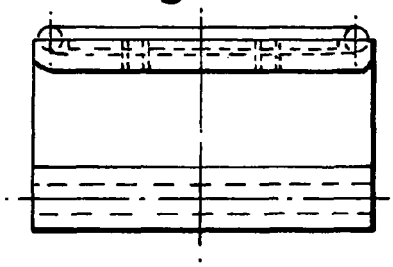
Figure 20E:
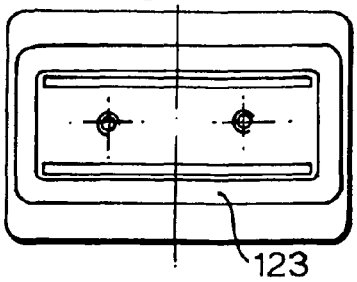
Figure 20F:
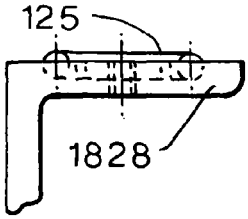
Figure 20G:
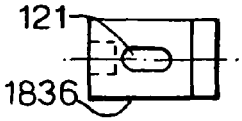
FIGS. 20G, 20H, 20I, 20J show the associated holding element with spring.
Figure 20H:
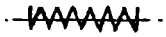
Figure 20I:
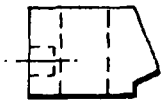
Figure 20J:
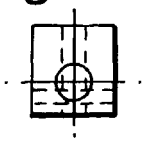
Figure 20K:
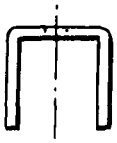
FIGS. 20K and 20L show the associated screwed on cylinder.
Figure 20L:
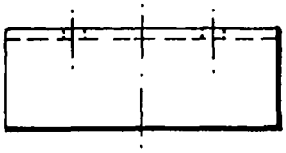

According to FIG. 19H, the two metal parts are thicker so that, together, they can receive the spring.

Figure 13A:
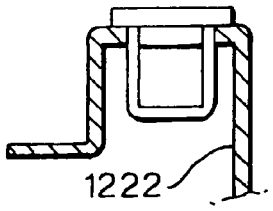
FIGS. 13A, 13B, 13C show an embodiment form with a body part that is welded to the holding plate
Figure 13B:
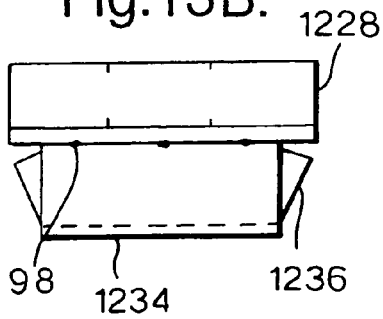
Figure 13C:
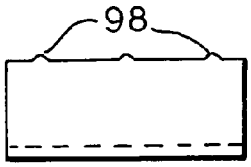
Figure 13D:
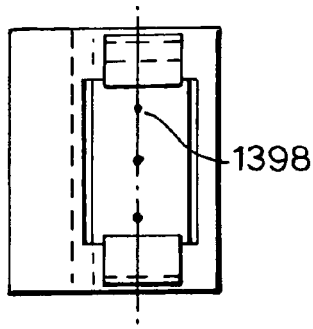
FIGS. 13D and 13E show an embodiment form with a holding spring that is welded to the body part.
Figure 13E:
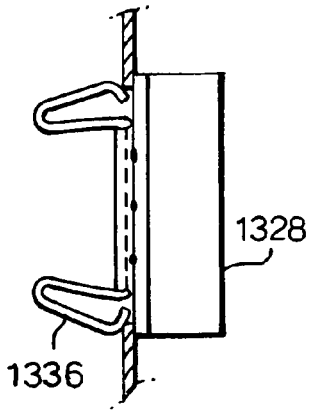

FIGS. 13A, 13B and 13C show an embodiment form in which the holding part 1234 is fastened to the head part 1228 by means of spot welding 98. In FIGS. 13E, 13D, a suitably formed leaf spring serving as a holding element is spot-welded at the body part 1328 (see weld 1398).

Figure 14A:
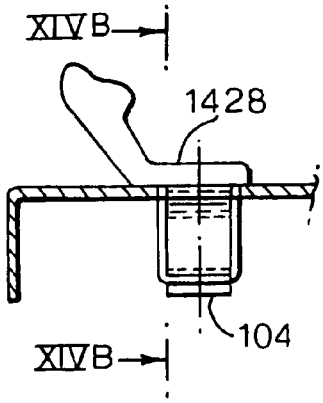
FIGS. 14A and 14B show an embodiment form with an insertable holding spring.
Figure 14B:
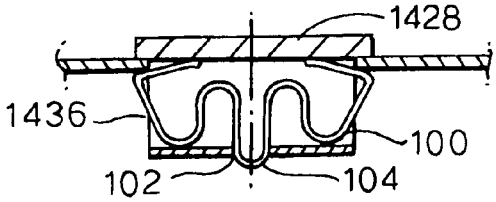
Figure 15A:
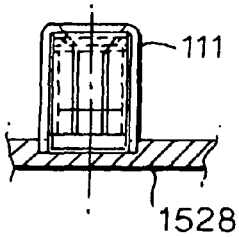
FIGS. 15A, 15B, 15C and 15D show an embodiment form in which a holding spring is screwed to a body part.
Figure 15B:
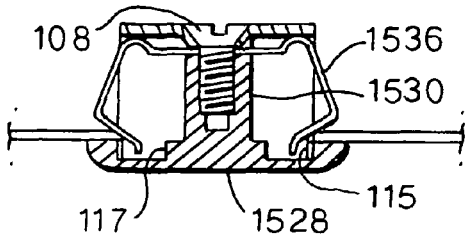
Figure 15C:
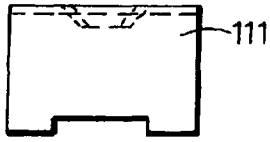
Figure 15D:
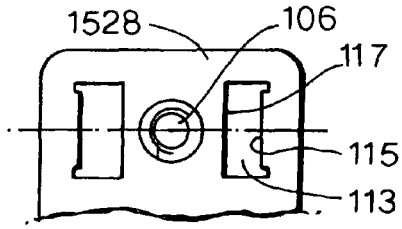
Figure 16A:
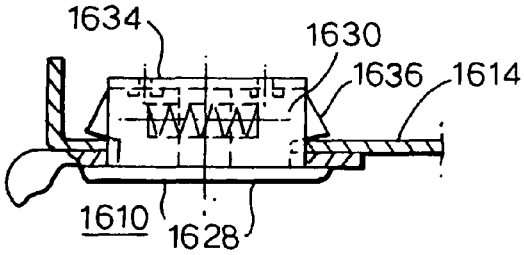
FIGS. 16A, 16B, 16C and 16D show different views of a holding element which is separate from the holding plate.
Figure 16B:
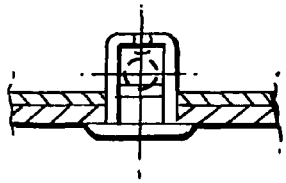
Figure 16C:
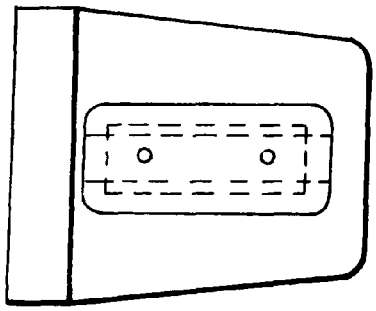
Figure 16D:
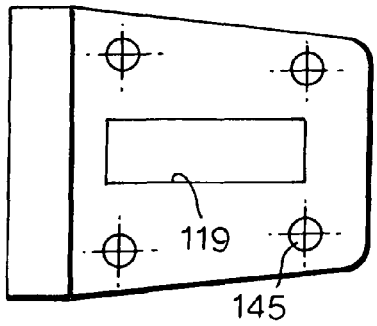

FIGS. 14A and 14B show a handle in which the leaf spring 1436 is inserted into a cavity 100 which is formed by the body part and which extends radially. This cavity forms a slot 102 or a projection and recess in which a projection and recess 104 of the spring 100 can lock the latter into position in a fixed manner.

In the hinge arrangement which is shown in FIGS. 15A, 15B, 15C and 15D, the leaf spring 1536 is held by a head screw 108 that is screwed into a threaded bore hole 106 formed by the body part 1530. A cover 111 can be provided for improved guidance. This cover 111 is U-shaped and engages by its leg ends into recesses 113 in the head part 1528. Further, these recesses 113 form stop surfaces 115 and 117 for the ends of the spring 1536.

FIGS. 16A, 16B, 16C and 16D show a handle in which the holding plate has an opening 119 like the thin wall 1614, wherein the holding part 1634 and the body part 1630 have their own head part 1628. Further, the holding plate shown in FIG. 16D has bore holes 145 for an alternative fastening by means of head screws.

Figure 17A:
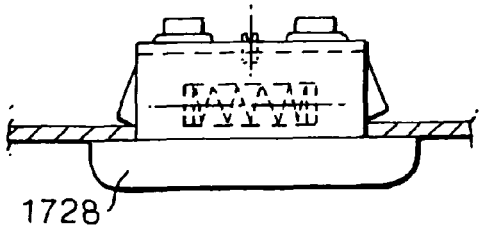
Figure 17B:
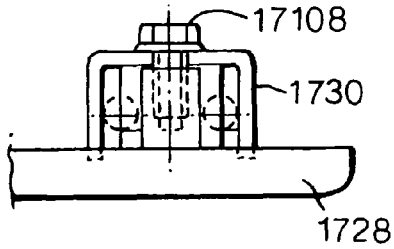
Figure 17C:
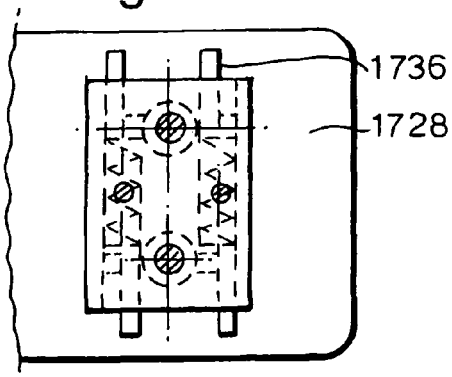

In the embodiment form shown in FIGS. 17A, 17B and 17C, the head part 1728 and body part 1730 are two parts which are screwed together, wherein two screws 17108 are used. In order to increase the stability, the pairs of holding elements 1736 are doubled and are arranged symmetrically on the right-hand and left-hand side of the screw arrangement 17108.

In the embodiment form shown in FIGS. 20A to 20L, the head part 1828 and body part 1830 are two different structural component parts which are screwed together 18107. The holding elements 1836 have an elongated hole 121 through which the screw 18107 is guided and the axial movement of the holding element 1836 is accordingly limited. The head part 1828 forming the handle has a groove 123 for a circumferential ring seal 125.

Figure 21:
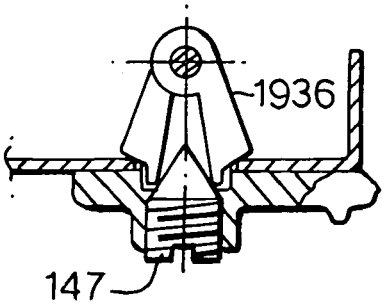
FIG. 21 shows a sectional top view of an embodiment form with a wedge screw.
Figure 23:
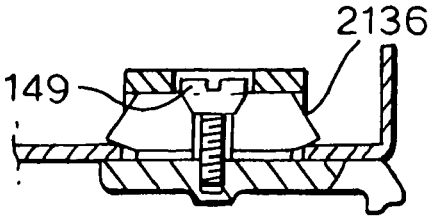
FIG. 23 shows a view similar to FIG. 21 to illustrate a wedge device in the form of a cabinet with a conical head.

FIG. 21 is a cross-sectional view in partial section showing a holding plate whose holding elements 1936 are spread by means of a screw with a conical base 147. In the embodiment form shown in FIG. 23, the head of the screw 149 is conical and presses the two holding elements 2136 apart.

Figure 22A:
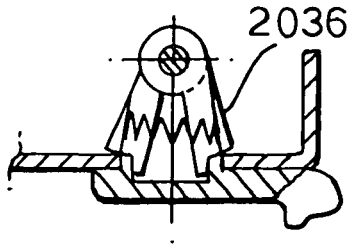
FIG. 22A shows an embodiment form with a round opening in a top view in partial section.

Compared to a construction according to FIG. 22A in which a spring spreads the two holding element 2036, the embodiment forms with the conical screw have the disadvantage that the screw must be tightened manually when the sheet metal edges become rounded or bulge out subsequently under load. A spring readjusts automatically and compensates automatically.

Figure 2:
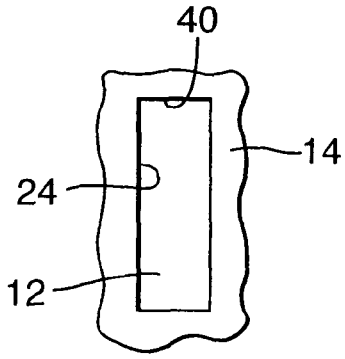
FIG. 2 shows an opening in the thin wall, which opening is suitable for the handle which is constructed according to the invention.
Figure 22B:
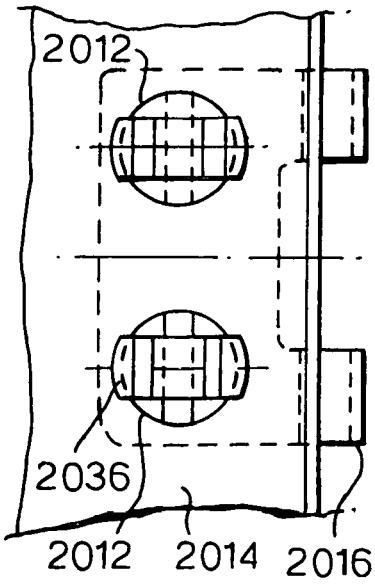
FIG. 22B is a bottom view according to FIG. 22A of a holding plate requiring two round openings.
Figure 22C:
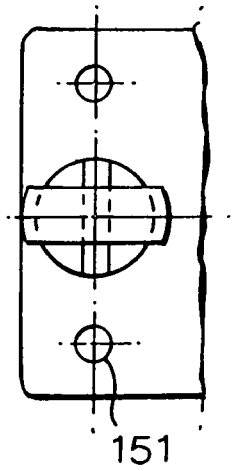
FIG. 22C shows a top view of a holding plate with a round opening and two guide holes.

The opening in the thin wall need not necessarily be rectangular as is shown, for example, in FIG. 2. In itself, it can also have any other shape, e.g., oval or round. A round embodiment form can be seen in FIG. 22B, in which case, however, means may have to be provided for preventing rotation, which is provided when the shape of the opening is rectangular, but not when the opening is round. The first holding plate (on the top with reference to FIG. 25A) can be secured, for example, by the second holding plate at the bottom in case these holding plates are connected to one another or by the arrangement of two round openings 2012 which are arranged at a distance from one another, as is shown in FIGS. 22B, or also by additional pins 151 which are cast integral with the hinge part and which prevent rotation (see FIG. 22C) insofar as there are corresponding bore holes in the door leaf which accept these pins.

Figure 24A:
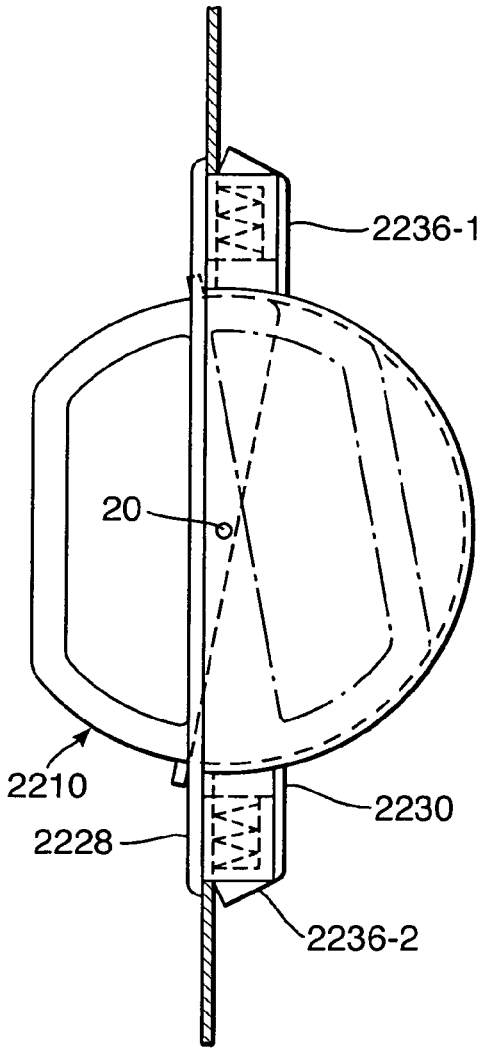
FIG. 24A shows a side view of a handle that can be lowered into a housing, which housing is held in an opening by means of holding elements according to the invention.

FIG. 24A is a view in longitudinal section showing a handle 2210 which can be lowered into a housing 18 that is held by means of fastening elements 2236-1, 2236-2, according to the invention, in an elongated, rectangular opening 2212.

The handle 2210 can be rotated around an axial pin 20 supported by the housing 18 until the handle is completely received by the housing; the back of the handle then closes the housing on the outer side and a smooth surface is formed.

Figure 24B:
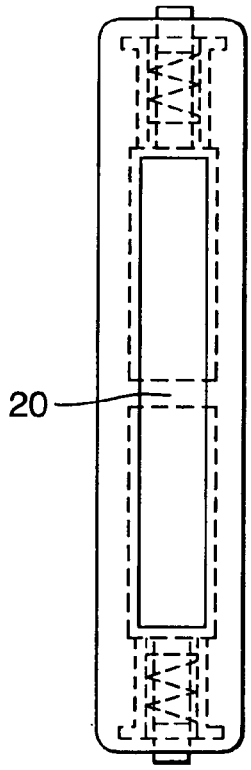
FIG. 24B shows a rear view of the arrangement according to FIG. 24A.
Figure 24C:
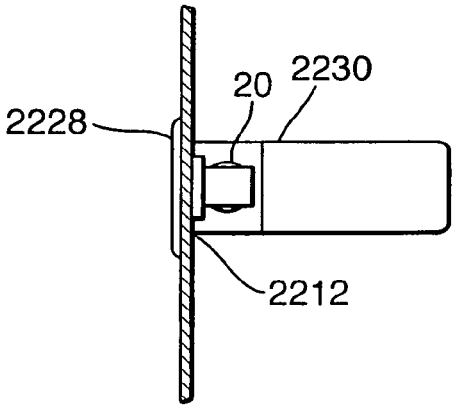
FIG. 24C shows a side view of the arrangement according to FIG. 24C.

FIG. 24B shows a rear view of the arrangement according to FIGS. 24A and FIG. 24C is a side view of the arrangement according to FIG. 24A.

Figure 25A:
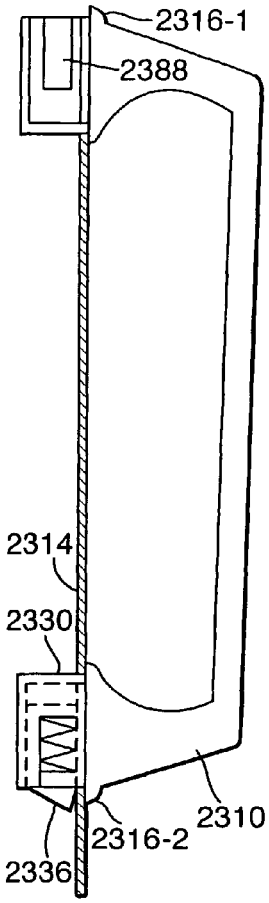
FIG. 25A is a longitudinal view in partial section showing a handle according to the invention that can be fastened in two round holes.
Figure 25B:
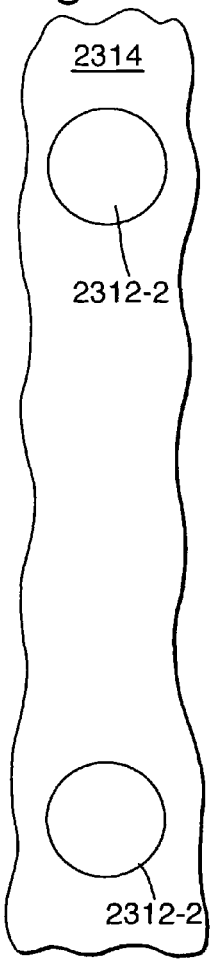
FIG. 25B shows the associated round holes in a thin wall.
Figure 25C:
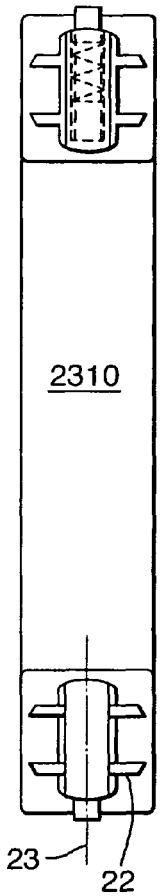
FIG. 25C shows a rear view of the arrangement according to FIG. 25A.
Figure 25D:
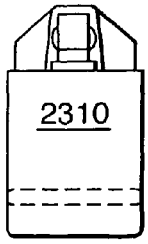
FIG. 25D shows a front view of the arrangement according to FIG. 25A.

FIG. 25A is a longitudinal view in partial section showing a handle which can be fastened, according to the invention, in two round holes 2312-1 and 2312-2 and whose two ends support a holding element, respectively, which lies in the direction of the handle axis. FIG. 25B shows the associated round holes 2312-1 and 2312-2 in a thin wall 2314, while FIG. 25C is a rear view showing the arrangement according to FIG. 25A. Webs 22 extending perpendicular to the handle axis 23 provide for fixing in the round hole 2312 in this direction perpendicular to the handle axis 23.

Figure 25E:
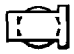
FIG. 25E shows a front view of the holding element of FIG. 25A.
Figure 25F:
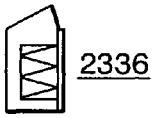
FIG. 25F shows a side view of the holding element of FIG. 25A.

FIG. 25E is a front view showing the shape of the holding element 2336 used in this case which can be inserted into a suitably shaped recess 2388 such that it can be locked (see the upper portion of FIG. 25A). The bottom portion of FIG. 25A shows this state. FIG. 25F is a side view of the holding element of FIG. 25A.

Figure 26:
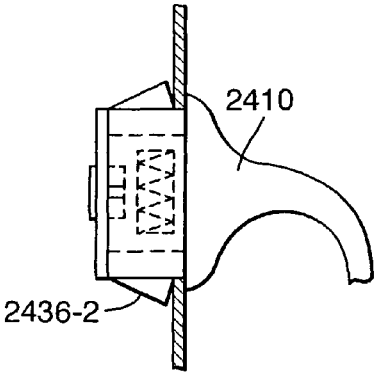
FIG. 26 shows an alternative embodiment form of the handle according to FIG. 25A.

FIG. 26 shows an alternative embodiment form of the handle according to FIG. 25A having two oppositely located holding elements 2436-1 and 2436-2 which provide for a flexible clamping in direction of the handle axis 23.

Figure 27A:
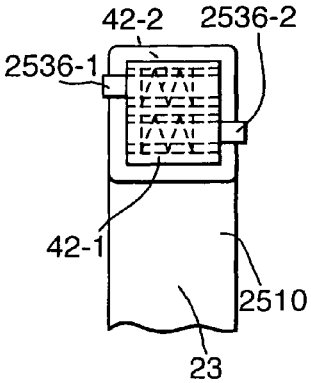
FIG. 27A shows another embodiment form of the handle according to FIG. 25A.

FIG. 27A shows another embodiment form of the handle 2510 in which the holding elements 2536-1 and 2536-2 are received in recesses lying perpendicular to the handle axis 23. Recesses of this kind can be produced in a simple manner by injection molding because no sliders are required in the injection molding die (the die is opened in this direction, that is, perpendicular to the handle axis). The two holding elements 2536-1 and 2536-2 are not coaxial to one another, but are parallel to one another at a distance from one another because otherwise the holding elements are too short and the axial guide is not sufficiently stable.

Figure 27B:
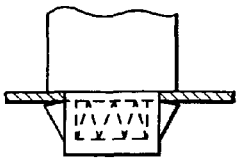
FIG. 27B shows a side view of the embodiment form of FIG. 27A.

FIG. 27B shows a side view of the embodiment form of FIG. 27A.

Figure 27C:
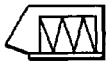
FIG. 27C shows a view of one of the holding elements of the handle according to FIG. 27A.

FIG. 27C shows a view of one of the holding elements of the handle according to FIG. 27A.

Figure 28A:
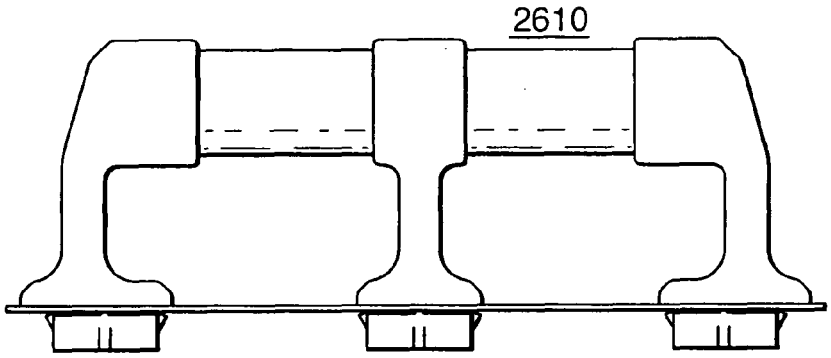
FIG. 28A is a side view showing a handle constructed according to the invention with more than two holding plates, in this case with three holding plates.
Figure 28B:
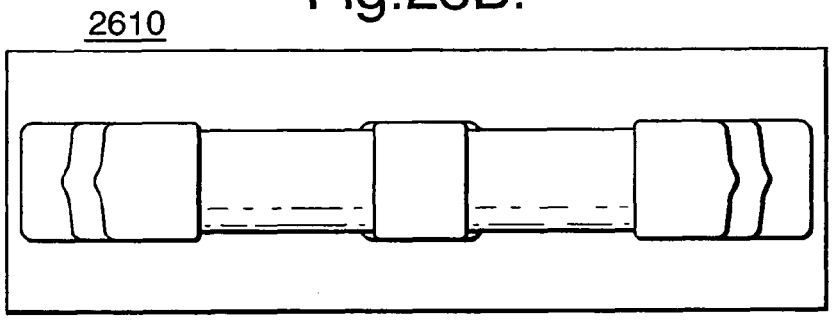
FIG. 28B is a top view showing a handle constructed according to the invention with more than two holding plates, in this case with three holding plates.
Figure 28C:
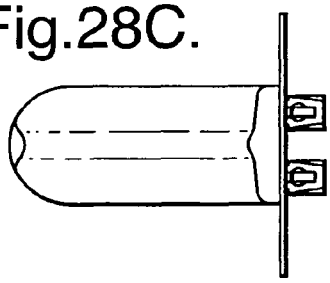
FIG. 28C is a front view showing a handle constructed according to the invention with more than two holding plates, in this case with three holding plates.
Figure 28D:
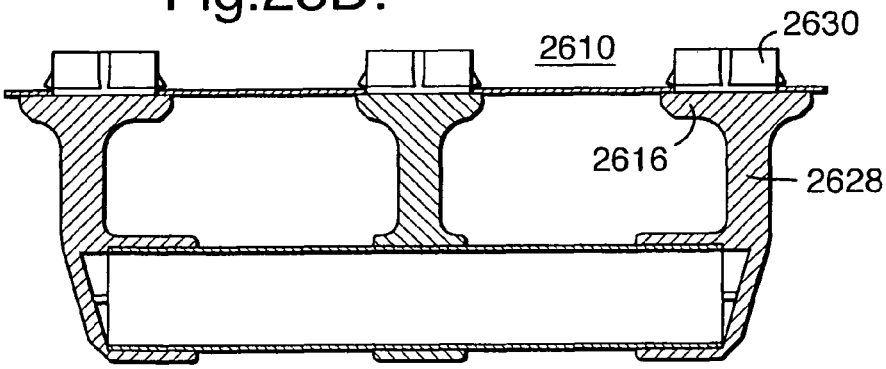
FIG. 28D is an axial sectional view showing a handle constructed according to the invention with more than two holding plates, in this case with three holding plates.
Figure 28E:
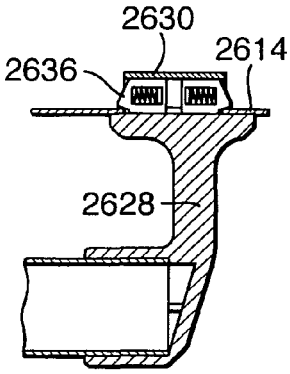
FIG. 28E is a partial sectional view showing a handle constructed according to the invention with more than two holding plates, in this case with three holding plates.

A handle constructed according to the invention is shown in a side view in FIG. 28A, in a top view in FIG. 28B, in a front view in FIG. 28C and in an axial sectional view in FIG. 28D. The handle has three holding plates 3630 each having two pairs of holding elements according to the invention in the body part 2630, while the respective head part 2628 receives one end of a handle bar 153 (or its middle part). Additional middle parts (not shown) can be provided.

Figure 28F:
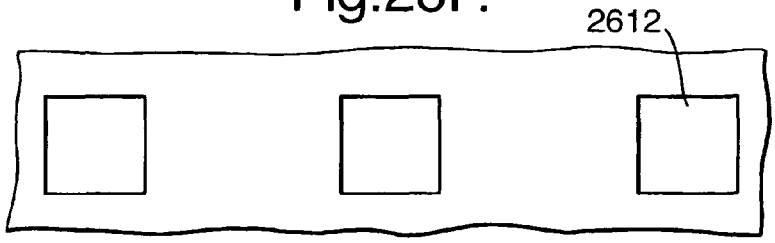
FIG. 28F shows a hole pattern in a thin wall, which hole pattern is suitable for the handle according to FIG. 28E.
Figure 28G:
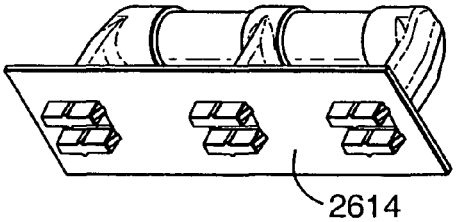
FIG. 28G shows a perspective view of the back of the thin wall with the mounted handle.
Figure 28H:
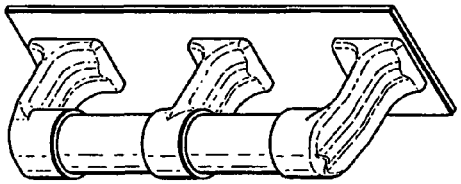
FIG. 28H shows a perspective view of the front side of the thin wall with the mounted handle.

FIG. 28F shows a hole pattern 2612 in a thin wall 2614, which hole pattern 2612 is suitable for the handle. FIG. 28G is a perspective view of the back of the thin wall 2614 with the mounted handle 2610. FIG. 28H is a perspective view of the front side of the thin wall with the mounted handle.

Figure 29A:
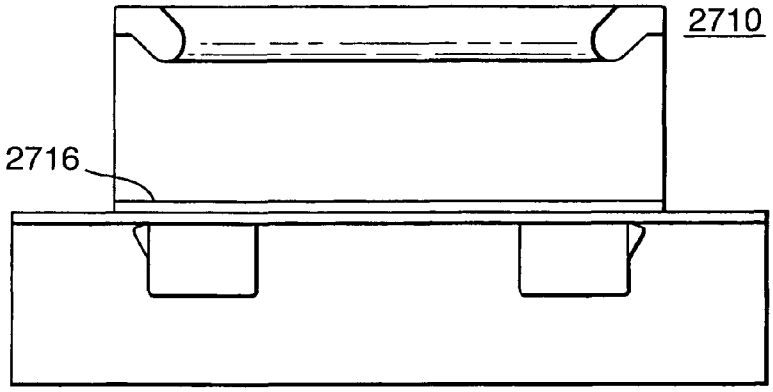
FIG. 29A shows a side view of a handle constructed according to the invention with a holding plate having two shoulders.
Figure 29B:
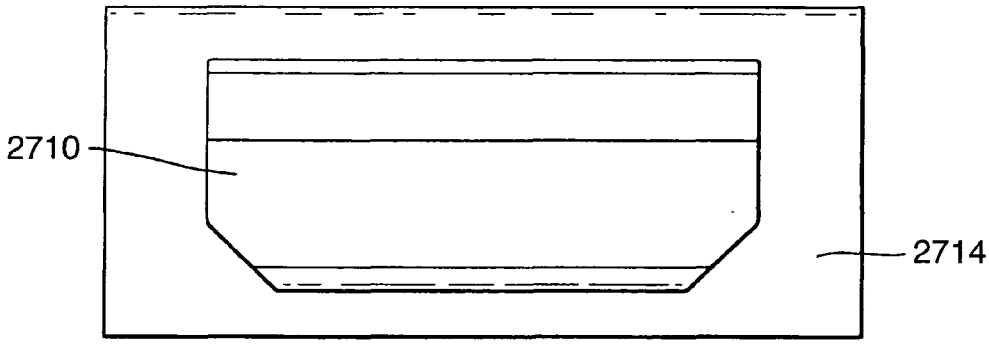
FIG. 29B shows a top view of a handle constructed according to the invention with a holding plate having two shoulders.
Figure 29C:
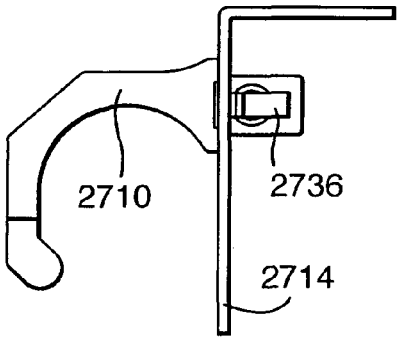
FIG. 29C shows a front view of a handle constructed according to the invention with a holding plate having two shoulders.
Figure 29E:
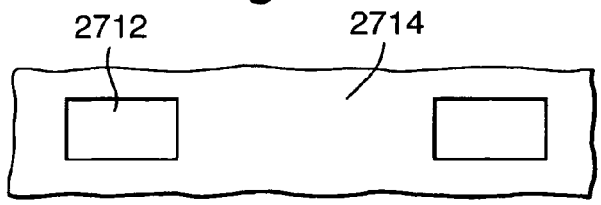
FIG. 29E shows a hole pattern in a thin wall, which hole pattern is suitable for the handle.
Figure 29D:
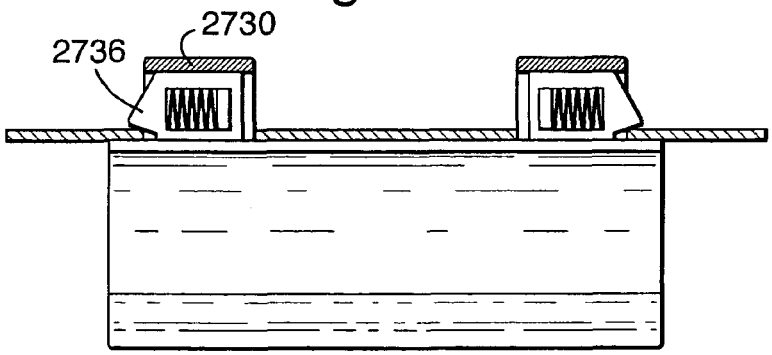
FIG. 29D shows an axial sectional view of a handle constructed according to the invention with a holding plate having two shoulders.

A handle 2710 constructed according to the invention with a holding plate 2716 with two shoulders 2730, each outfitted with a holding element 3736, is shown in a side view in FIG. 29A, in a top view in FIG. 29B, in a front view in FIG. 29C, and in axial section in FIG. 29D.

Figure 29F:
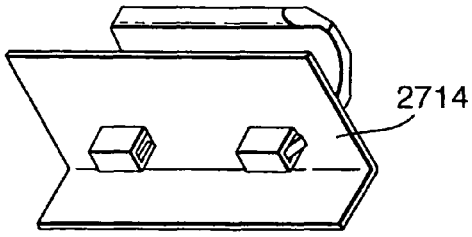
FIG. 29F is a perspective view of the back of the thin wall with the mounted handle.
Figure 29G:
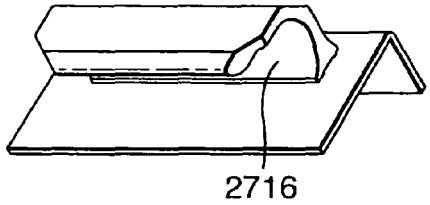
FIG. 29G shows a perspective view of the front of the thin wall with the mounted handle.

FIG. 29E shows a hole pattern 2716 in a thin wall 2714, which hole pattern 2716 is suitable for the handle. FIG. 29F is a perspective view of the back of the thin wall 2714 with the mounted handle 2710, and FIG. 29G is a perspective view of the front side of the thin wall with the mounted handle.

Figure 30A:
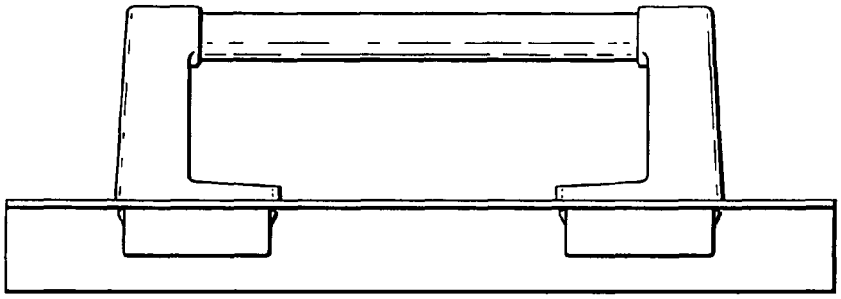
FIG. 30A is a side view of a handle constructed according to the invention with two holding plates.
Figure 30B:
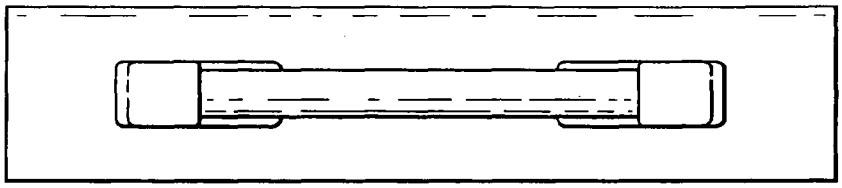
FIG. 30B is a top view of a handle constructed according to the invention with two holding plates.
Figure 30C:
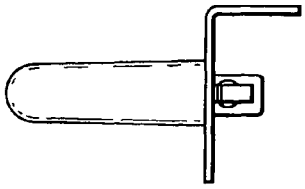
FIG. 30C is a front view of a handle constructed according to the invention with two holding plates.
Figure 30E:
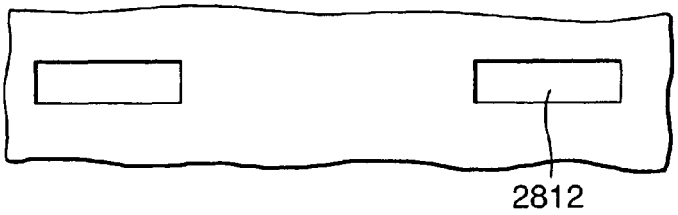
FIG. 30E shows a hole pattern in a thin wall, which hole pattern is suitable for the handle.
Figure 30D:
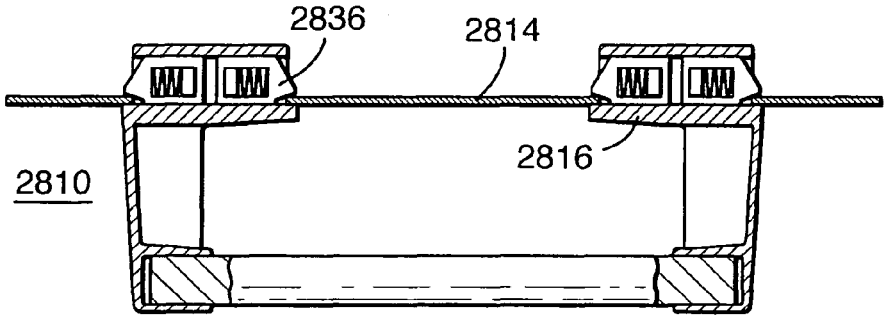
FIG. 30D is an axial sectional view of a handle constructed according to the invention with two holding plates.
Figure 30F:
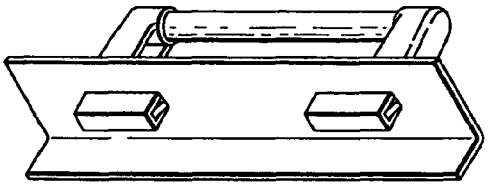
FIG. 30F is a perspective view of the back of the thin wall with the mounted handle.
Figure 30G:
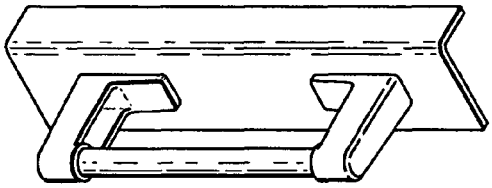
FIG. 30G is a perspective view of the front of the thin wall with the mounted handle.
Figure 31A:
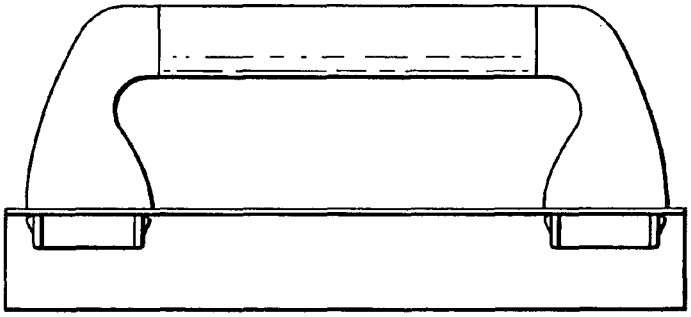
FIGS. 31A to 31G show the view corresponding to FIGS. 30A to 30G of another handle constructed according to the invention with two holding plates.
Figure 31B:
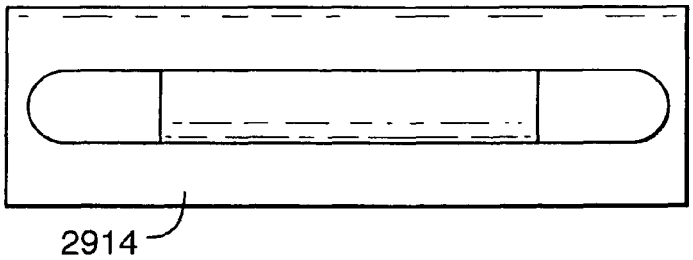
Figure 31C:
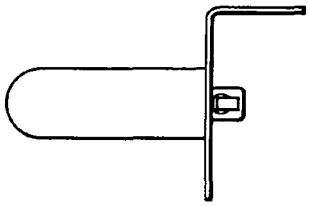
Figure 31D:
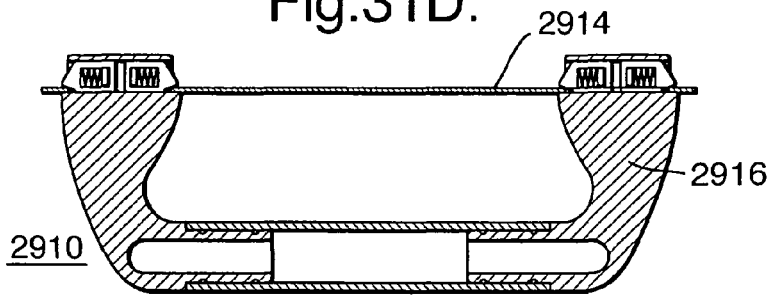
Figure 31E:
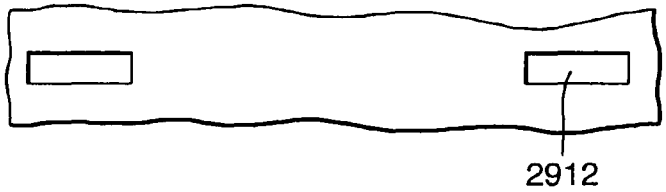
Figure 31F:
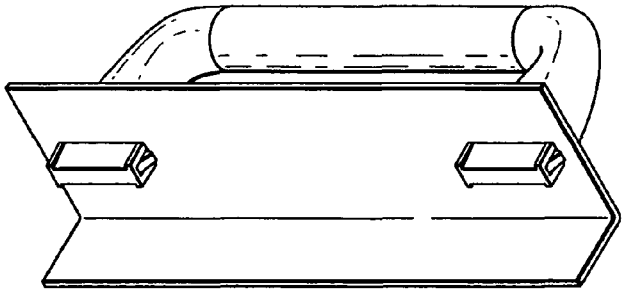
Figure 31G:
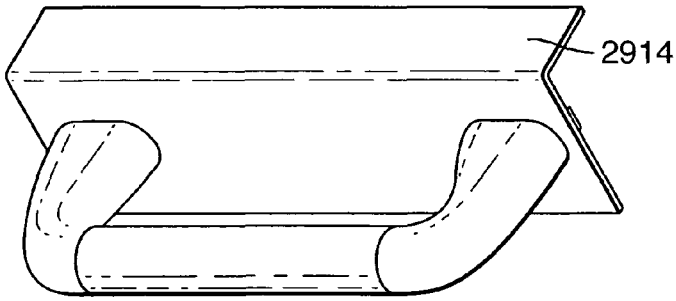
Figure 32A:
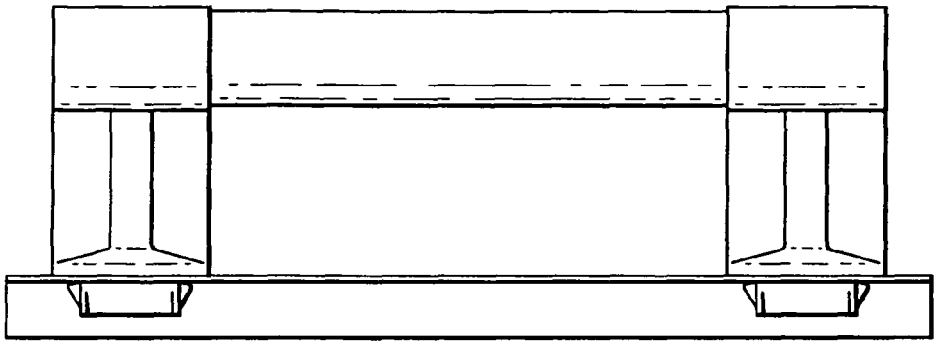
FIGS. 32A to 32G are views corresponding to FIGS. 30A to 30G showing another handle constructed according to the invention with two holding plates.
Figure 32B:
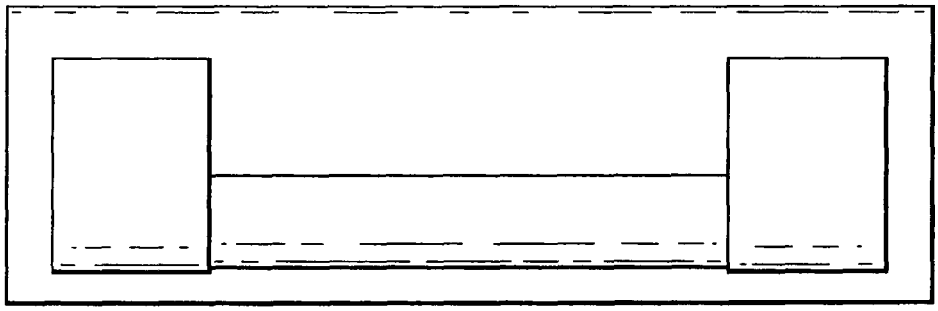
Figure 32C:
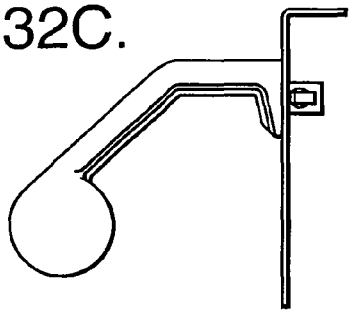
Figure 32D:
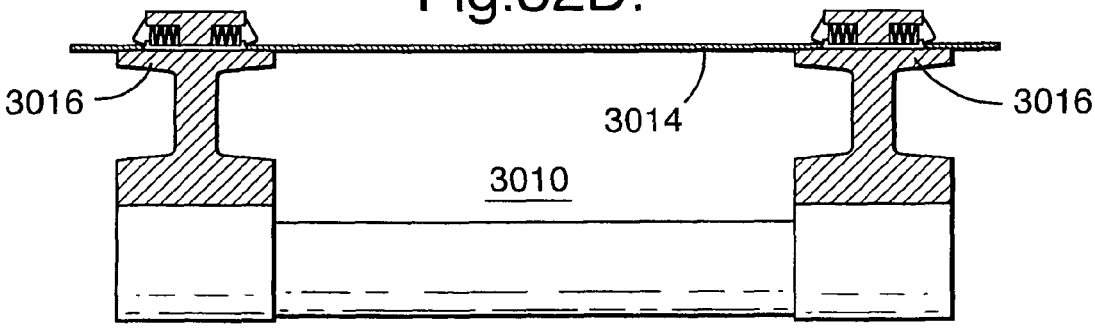
Figure 32E:
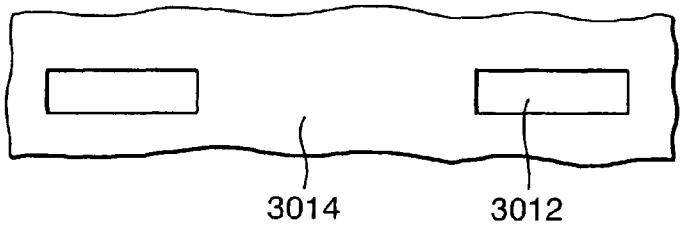
Figure 32F:
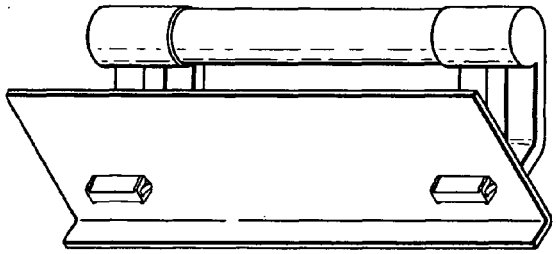
Figure 32G:
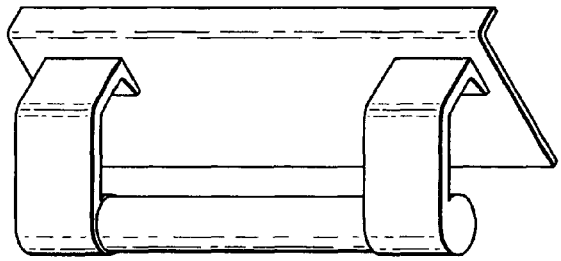

A handle 2810 constructed according to the invention with two holding plates 2816 is shown in a side view in FIG. 30A, in a top view in FIG. 30B, in a front view in FIG. 30C, and in axial section in FIG. 30D. FIG. 30E shows a hole pattern 2812 in a thin wall 2814, which hole pattern 2814 is suitable for the handle 2810. FIG. 30F is a perspective view of the back of the thin wall with the mounted handle. FIG. 30G is a perspective view of the front side of the thin wall 2814 with the mounted handle 2810.

FIGS. 31A to 31G are corresponding views of another handle 2910 constructed according to the invention with two holding plates 2916.

FIGS. 32A to 32G show corresponding views of another handle 3010 constructed according to the invention with two holding plates 3016.

Figure 33A:
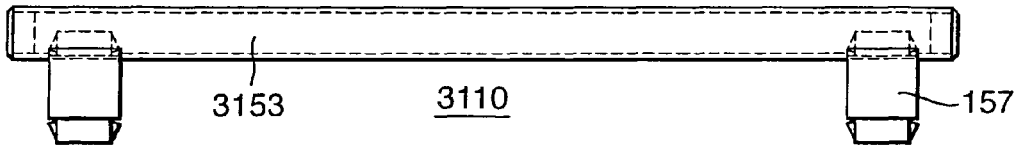
FIG. 33A is a side view showing another handle with two holders.
Figure 33B:
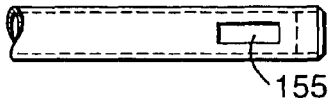
FIG. 33B is a partial bottom view showing the same handle with two holders.
Figure 33C:
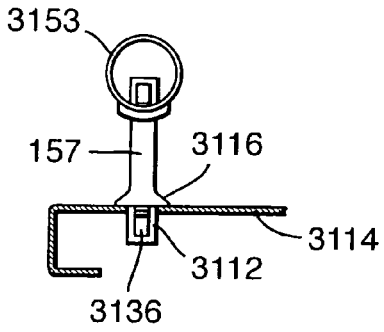
FIG. 33C is a front view showing the same handle with two holders.
Figure 33D:
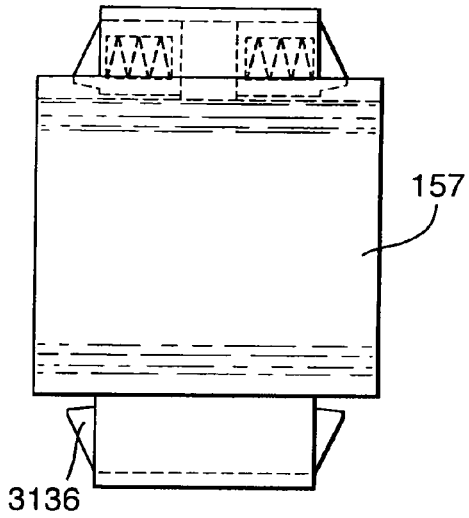
FIG. 33D is an enlarged partial side view showing the same handle with two holders.
Figure 33E:
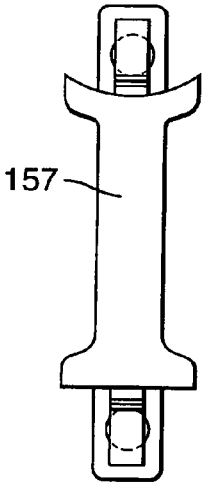
FIG. 33E is an enlarged front view showing the same handle with two holders.

FIG. 33A is a side view showing a handle 3110 with a bar 3153 which itself forms a thin wall in which an opening 155 is provided. A spacer 157 can be clipped into the thin wall in a manner according to the invention by one end that is adapted to the curve of the bar, while the other end of the spacer can be fastened in an opening in a sheet-metal wall or the like also in the embodiment forms mentioned above. This handle 3110, with two holders that can be clipped in at both ends, is also shown in partial bottom view in FIG. 33B, in a front view in FIG. 33C, in an enlarged partial side view in FIG. 33D, and in an enlarged front view of this handle 3110 in FIG. 33E.

Figure 34A:
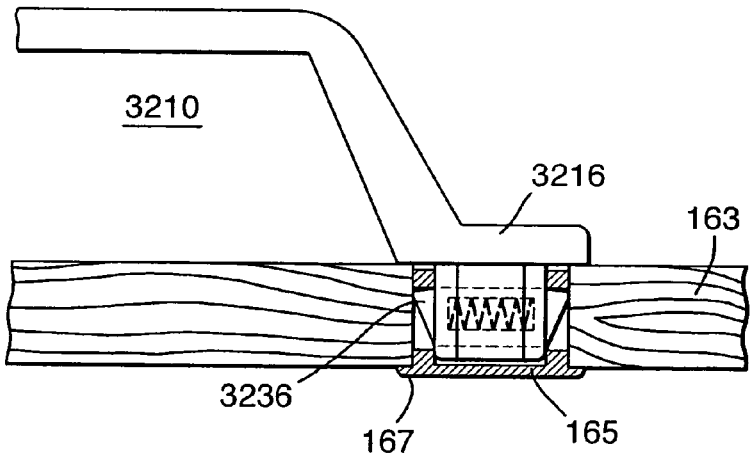
FIGS. 34A to 34C show different views of another handle constructed according to the invention with two holding plates for indirect fastening for use in a thick wall.
Figure 34B:
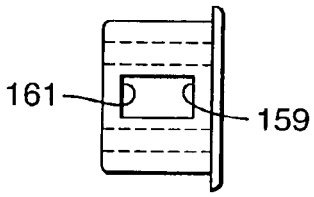
Figure 34C:
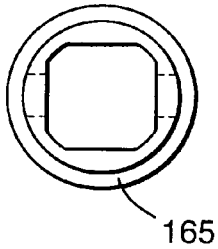

FIGS. 34A to 34C show another handle 3210 constructed according to the invention with two holding plates 3216 for indirect fastening for use in thick walls. Instead of the thin wall, there is a web edge 161 of an opening 159 in an insert 165 introduced into a thick wall, a holding element 3236 according to the invention engages behind this web edge. The thick wall, e.g., a wooden board, is clamped in by the flange 167 and the holding plate 3216.

COMMERCIAL APPLICABILITY

The invention is commercially applicable in switch cabinet construction, apparatus engineering, appliance engineering, construction of paneling in machine engineering and in furniture construction.

While the foregoing description and drawings represent the present invention, it will be obvious to those skilled in the art that various changes may be made therein without departing from the true spirit and scope of the present invention.

Reference Numbers

10, 2210, 2410, 2510,
2610, 2710, 2810, 2910, 3010 handle
12, 2012, 2312, 2612,
2712, 2812, 2912, 3012 rectangular, round opening
14, 214, 514, 1014, 1614,
2314, 2614, 2714, 2814, 2914, 3014 thin wall, door leaf, sheet-metal cabinet door
16, 316, 2316, 2716,
2816, 2916, 3016, 3116, 3216 holding plate
18 housing
20 axis
22 web
24 handle axis
26 front, outer side of the thin wall 14
28, 428, 1228, 1328,
1528, 1628, 1728, 1828, 2628 head part, flange, eyelet of a handle
30, 330, 830, 1030, 1130,
1530, 1630, 1730, 1830, 2630, 2730 body part
32 rear, inner side of the thin wall 14
34, 434, 1234, 1634 holding part
36, 36-1, 36-2, 236, 136, 436, 536,
636, 736, 1136, 1436, 1836, 1936,
2036, 2136, 2326, 2436, 2536, 2636,
2726, 2836, 3136 holding element
38 inclined surface
40 edge, rim
42, 42-1, 42-2, 342, 242, 542
742, 842, 1142 spring arrangements, coil spring
44 lever
46, 446 axial pin
48 stop arrangements
50 rectangular cylinder
52, 352 slide
54, 354 locking hook arrangement
56, 156 wedge, pin
58 axis
60 opening edge
62 bevel
64 clamping surface
66 fixing plug
68 spring space
70 offset
72 offset
74 support
76 projection
78 groove
80 bar lock
82 tool, key, lever
83 pinion
84 opening
86 projections
88 recess for holding elements
90 recess for spring
92, 192 cutout for holding element
94 knob
95 reinforcement plate
96 reinforcement plate
98, 1398 spot weld
100 cavity
102 slot, recess
104 recess, projection
106 threaded bore hole
108, 17108, 18107 head screw
111 cover
113 recess
115 stop surface
117 stop surface
119 opening
121 elongated hole
123 groove
125 ring seal
127 inclined surface
129 channel wall
131 fixing plug
133 unlocking key
135 opening
137 channel cover
139 offset area
141 wing
143 surface
145 bore holes
147 screw with conical base
149 screw with conical head
151 pin
153, 1353 handle bar
155 opening
157 spacer
159 opening
161 web edge
163 thick wall
165 insert
167 flange

The invention claimed is:

1. A handle comprising:

at least one holding plate which can be mounted in an opening in a thin wall such as a sheet-metal cabinet door;

a head part, for overlapping a rim of the opening of the thin wall on its outer side;

a body part which proceeds from the head part and can be pushed through the opening in the thin wall; and a holding part which is carried by the body part, supported on the other side of the thin wall, and is separate from the body part;

wherein said holding part is formed by into holding elements which project in a flexible manner from the body part in the direction of its outer surface, each of the holding elements having a free end which has a smooth inclined surface for supporting the body part on the rim or edge of the opening without play;

wherein the two holding elements are arranged diametrical to one another and are acted upon by two coil springs; and wherein the inclined surface of each holding element is inclined with respect to a surface of the other side of the thin wall.

2. The handle according to claim 1;

wherein the holding elements are levers which are arranged at a distance from the surface of the thin wall so as to be rotatable in a defined manner around an axis parallel to the plane of the thin wall.

3. The handle according to claim 1;

wherein the holding elements are levers which are arranged so as to be rotatable around an axis perpendicular to the surface of the thin wall.

4. The handle according to claim 1;

wherein the holding elements are slides which are arranged so as to be displaceable in a cylinder that lies parallel to the plane of the thin wall and is rectangular in cross section and are held against the force of a pressure spring by a hook arrangement that locks between the slides themselves or in the cylinder.

5. The handle according to claim 1;

wherein the holding elements are slides of rigid material which are arranged so as to be displaceable in a cylinder that is parallel to the plane of the thin wall and rectangular in cross section and are held against the force of a pressure spring by a pin arrangement that is arranged between them.

6. The handle according to claim 4;

wherein the cylinder has a partial dividing wall or undercut or opening edge at which the slides are supported axially by a shoulder or hook.

7. The handle according to claim 1;

wherein the holding element has an opening which receives a spiral pressure spring by at least a portion of its diameter.

8. The handle according to claim 7;

wherein projections which hold the spring element radially project into the opening.

9. The handle according to claim 7;

wherein the holding elements are formed by two flat metal pieces lying next to one another, each of which has an opening, these two openings together forming a space which receives a spiral pressure spring by at least a portion of its diameter.

10. The handle according to claim 7;

wherein the holding elements are formed by two metal pieces which lie next to one another and which form projections and recesses which are directed toward one another and which limit the axial sliding movement relative to one another.

11. The handle according to claim 1;

wherein the holding elements are formed by two plastic pieces or metal pieces which lie next to one another and which form projections and recesses which are directed toward one another and which can be engaged by a rotatable tool or key in such a way that the plastic pieces or metal pieces are displaced relative to one another against the spring force when the tool or key is turned.

12. The handle according to claim 7;

wherein the holding elements are formed by a metal piece or by two metal pieces lying next to one another which is/are held jointly by a spring in such a way that these two or three parts form a manageable unit that is stable in itself.

13. The handle according to claim 5;

wherein a fixing pin or fixing plug or fixing screw is provided for fixing the holding elements after the holding plate is mounted in the opening.

14. The handle according to claim 1;

wherein the head part has a recess in the area of the holding elements.

15. The handle according to claim 1;

wherein the holding plate has an opening and the holding part and the body part have their own head part.

16. The handle according to claim 15;

wherein the head part and body part are two parts that are screwed together.

17. The handle according to claim 1;

wherein a plurality of holding elements are arranged next to one another in axial direction of the handle.

18. The handle according to claim 1;

wherein a second holding plate, which is connected to the first holding plate by means of a handle bar, has a construction analogous to that of the first holding plate.

19. The handle according to claim 1;

wherein the handle can penetrate into or be swiveled into or rotated into a housing carrying the holding elements.

20. The handle according to claim 1;

wherein the handle has an elongated shape and forms a holding plate at both ends and holding elements proceed from the latter.

21. The handle according to claim 20;

wherein the holding elements are pretensioned in a flexible manner in direction of the handle axis.

22. The handle according to claim 20;

wherein the holding elements are pretensioned in a flexible manner perpendicular to the direction of the handle axis.

23. The handle according to claim 1;

wherein the handle has a spacer which can be clipped in at both ends into openings in a thin wall.

24. The handle according to claim 1;

wherein the holding elements of the handle holding plate engage behind a web or recess instead of a thin wall, which web or recess is formed by an insert which is insertable into a thick wall.

25. The handle according to claim 24;

wherein the thick wall is clamped in between a flange area of the insert and the base plate of the handle.

* * * * *